US009493726B2

(12) United States Patent
Vinson et al.

(10) Patent No.: US 9,493,726 B2
(45) Date of Patent: Nov. 15, 2016

(54) DETERGENT COMPOSITIONS CONTAINING A PREDOMINANTLY C15 BRANCHED ALKYL ALKOXYLATED SURFACTANT

(71) Applicant: The Procter & Gamble Company, Cincinnati, OH (US)

(72) Inventors: Phillip Kyle Vinson, Fairfield, OH (US); Patrick Christopher Stenger, Fairfield, OH (US); Melinda Phyllis Steffey, Liberty Township, OH (US); Randall Thomas Reilman, Cincinnati, OH (US); Clemens Schröder, Kayhude (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/847,028

(22) Filed: Sep. 8, 2015

(65) Prior Publication Data

US 2016/0068785 A1 Mar. 10, 2016

Related U.S. Application Data

(60) Provisional application No. 62/047,262, filed on Sep. 8, 2014.

(51) Int. Cl.

| | |
|---|---|
| ***C11D 1/12*** | (2006.01) |
| ***C11D 1/29*** | (2006.01) |
| ***C11D 3/386*** | (2006.01) |
| ***C11D 1/14*** | (2006.01) |
| ***C11D 1/37*** | (2006.01) |

(52) U.S. Cl.

CPC ..... *C11D 1/146* (2013.01); *C11D 1/37* (2013.01); *C11D 3/386* (2013.01); *C11D 3/38627* (2013.01); *C11D 3/38636* (2013.01); *C11D 3/38645* (2013.01); *C11D 1/29* (2013.01)

(58) Field of Classification Search

CPC ..... C11D 1/12; C11D 1/29; C11D 3/182; C11D 3/2017; C11D 3/202; C11D 3/386; C11D 7/242; C11D 11/017

See application file for complete search history.

(56) References Cited

U.S. PATENT DOCUMENTS

| | | | | |
|---|---|---|---|---|
| 3,480,556 | A | 11/1969 | DeWitt et al. | |
| 3,786,003 | A | 1/1974 | Hunter et al. | |
| 5,780,694 | A | 7/1998 | Singleton et al. | |
| 5,849,960 | A | 12/1998 | Singleton et al. | |
| 5,919,987 | A | 7/1999 | Kneuper et al. | |
| 5,968,888 | A | 10/1999 | Blandiaux | |
| H1818 | H | 11/1999 | Potgieter et al. | |
| 6,037,317 | A | 3/2000 | Rapisarda et al. | |
| 6,150,322 | A | 11/2000 | Singleton et al. | |
| 6,165,961 | A | 12/2000 | Schmid et al. | |
| 6,166,262 | A | 12/2000 | Connor | |
| 6,222,077 | B1 | 4/2001 | Singleton | |
| 6,573,229 | B2 | 6/2003 | Creeth et al. | |
| 6,617,303 | B1 | 9/2003 | Smith et al. | |
| 6,660,708 | B2 | 12/2003 | Kaess | |
| 6,706,931 | B2 | 3/2004 | Edwards et al. | |
| 6,737,553 | B1 | 5/2004 | Maas et al. | |
| 6,765,106 | B2 | 7/2004 | Fenouil et al. | |
| 6,891,056 | B2 | 5/2005 | Edwards et al. | |
| 7,037,883 | B2 | 5/2006 | Hsu et al. | |
| 7,071,364 | B2 | 7/2006 | Edwards et al. | |
| 7,148,375 | B2 | 12/2006 | Edwards | |
| 7,175,799 | B2 | 2/2007 | Hori et al. | |
| 7,183,446 | B2 | 2/2007 | Zeller et al. | |
| 7,256,317 | B2 | 8/2007 | Maas et al. | |
| 7,365,234 | B2 | 4/2008 | Subramaniam et al. | |
| 7,781,390 | B2 | 8/2010 | Singleton et al. | |
| 7,871,973 | B1 | 1/2011 | Singleton et al. | |
| 7,888,307 | B2 | 2/2011 | Singleton et al. | |
| 8,123,867 | B2 | 2/2012 | Tropsch | |
| 8,173,847 | B2 | 5/2012 | Fischbach et al. | |
| 2001/0009927 | A1 | 7/2001 | Weerasooriya et al. | |
| 2002/0010124 | A1 | 1/2002 | Creeth et al. | |
| 2002/0039983 | A1 | 4/2002 | Bodet et al. | |
| 2005/0020468 | A1* | 1/2005 | Frantz | A61K 8/463 510/424 |
| 2005/0124526 | A1* | 6/2005 | D'Angelo | A61K 8/463 510/424 |
| 2007/0111924 | A1 | 5/2007 | Ford | |
| 2009/0005449 | A1 | 1/2009 | Gunn et al. | |
| 2009/0023625 | A1 | 1/2009 | Tang et al. | |
| 2009/0192067 | A1 | 7/2009 | Dery et al. | |
| 2010/0303739 | A1 | 12/2010 | Spoerer et al. | |
| 2010/0323946 | A1 | 12/2010 | Connors | |
| 2016/0068784 | A1 | 3/2016 | Vinson et al. | |

FOREIGN PATENT DOCUMENTS

| | | | |
|---|---|---|---|
| EP | 0 364 012 | A1 | 4/1990 |
| EP | 0 439 316 | B1 | 7/1991 |
| EP | 0 684 300 | A2 | 11/1995 |
| EP | 0 763 525 | B1 | 3/1997 |
| EP | 0 846 094 | B1 | 6/1998 |

(Continued)

OTHER PUBLICATIONS

PCT International Search Report for International Application No. PCT/US2015/048827, dated Mar. 14, 2016, containing 27 pages.
PCT International Search Report for International Application No. PCT/US2015/048827, dated Jan. 5, 2016 containing 12 pages.
PCT International Search Report for International Application No. PCT/US2015/048818, dated Dec. 22, 2015, containing 12 pages.
LIAL® | ALCHEM® | ISALCHEM®, C9-C17 alcohols 11/13 GB, pp. 1-14; www.sasol.com.
Sasol Olefins & Surfactants, ISOFOL® C12-C32; Defined Branched Guerbet Alcohols, pp. 1-12; www.sasol.com.
Sasol Olefins & Surfactants, ISOFOL® C12-C32; Defined Branched Guerbet Alcohols, pp. 1-16; www.sasol.com.

(Continued)

*Primary Examiner* — Charles Boyer
(74) *Attorney, Agent, or Firm* — Melissa Krasovec; Leonard W. Lewis; Steven W. Miller

(57) ABSTRACT

The present invention relates generally to detergent compositions and, more specifically, to detergent compositions containing a branched surfactant.

13 Claims, No Drawings

(56) References Cited

FOREIGN PATENT DOCUMENTS

| | | | |
|---|---|---|---|
| EP | 0 900 181 | B1 | 3/1999 |
| EP | 0 958 267 | B1 | 11/1999 |
| EP | 0 342 917 | B1 | 3/2000 |
| EP | 1 272 605 | B1 | 8/2003 |
| EP | 1 664 254 | B1 | 6/2006 |
| EP | 2 297 287 | B1 | 3/2011 |
| GB | 1257679 | | 12/1971 |
| GB | 2265379 | A | 9/1993 |
| JP | 08-188793 | A | 1/1995 |
| JP | 08-188794 | A | 1/1995 |
| JP | 2001187895 | A | 7/2001 |
| WO | WO 88/07030 | | 9/1988 |
| WO | WO 93/02660 | | 2/1993 |
| WO | WO 97/38956 | | 10/1997 |
| WO | WO 01/79408 | A1 | 10/2001 |
| WO | WO 2005/026302 | A1 | 3/2005 |
| WO | WO 2011/028180 | | 3/2011 |
| WO | WO 2016/040248 | A3 | 3/2016 |

OTHER PUBLICATIONS

T.P. Matson, The Workhorse Surfactants: Sulfates, and Ether Sulfates LAS, Alcohol; J. Am. Oil Chemists' Soc., Jan. 1978, pp. 66-69, vol. 55.

C,F, Putnik and S.E. McGuire, The Effect of Reaction By-products on the Viscosities of Sodium Lauryl Sulfate Solutions; Journal of the American Oil Chemisis' Society, vol. 55 No. 12, pp. 909-913 (1978).

Suardi, Marco Alessandro, Mainly branched fatty alcohols from conventional and modified oxo-synthesis with a methyl group along the main chain, their mixtures, derivatives and use., IPCOM000192536D; IP.com Electronic Publication: Jan. 22, 2010; http://www.ip.com/pubview/IPCOM000192536D.

A. S. Davidsohn and B. Mil Widsky, Synthetic Detergents, May 1987, pp. 14-17, vol. 7, Longman Higher Education; ISBN-10 058246238X.

* cited by examiner

DETERGENT COMPOSITIONS CONTAINING A PREDOMINANTLY C15 BRANCHED ALKYL ALKOXYLATED SURFACTANT

TECHNICAL FIELD

The present invention relates generally to detergent compositions and, more specifically, to detergent compositions containing a branched surfactant.

BACKGROUND

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot water washes, the demands on low-temperature detergents are especially high.

Branched surfactants are known to be particularly effective under cold water washing conditions. For example, surfactants having branching towards the center of the carbon chain of the hydrophobe, known as mid-chain branched surfactants, are known for cold-water cleaning benefits. 2-alkyl branched or "beta branched" primary alkyl sulfates (also referred to as 2-alkyl primary alcohol sulfates) are also known. 2-alkyl branched primary alkyl alkoxy sulfates have 100% branching at the C2 position (C1 is the carbon atom covalently attached to the alkoxylated sulfate moiety). 2-alkyl branched alkyl sulfates and 2-alkyl branched alkyl alkoxy sulfates are generally derived from 2-alkyl branched alcohols (as hydrophobes). 2-alkyl branched alcohols, e.g., 2-alkyl-1-alkanols or 2-alkyl primary alcohols, which are derived from the oxo process, are commercially available from Sasol, as ISALCHEM®. 2-alkyl branched alcohols (and the 2-alkyl branched alkyl sulfates derived from them) are positional isomers, where the location of the hydroxymethyl group (consisting of a methylene bridge (—$CH_2$— unit) connected to a hydroxy (—OH) group) on the carbon chain varies. Thus, a 2-alkyl branched alcohol is generally composed of a mixture of positional isomers. Also, commercially available 2-alkyl branched alcohols include some fraction of linear alcohols. For example, Sasol's ISALCHEM® alcohols are prepared from Sasol's oxo-alcohols (LIAL® Alcohols) by a fractionation process that yields greater than or equal to 90% 2-alkyl branched material, with the remainder being linear material. 2-alkyl branched alcohols are also available in various chain lengths. 2-alkyl primary alcohol sulfates having alkyl chain length distributions from twelve to twenty carbons are known. ISALCHEM® alcohols in the range of C9-C17 (single cuts and blends), including ISALCHEM® 145 ($C_{14}$-$C_{15}$-alcohols) and ISALCHEM® 167 ($C_{16}$-$C_{17}$-alcohols), are commercially available. Alcohol ethoxylates based on ISALCHEM® 123 are available under the tradename COSMACOL® AE-3.

Laundry detergents containing a commercial C14/C15 branched primary alkyl sulfate, namely LIAL® 145 sulfate, which contains 61% branching and 30% C4 or greater branching (branch contains at least four carbon atoms), are known. Detergents containing a mixture of a straight chain primary alkyl sulfate and a beta-branched chain primary alcohol sulfate, where the total number of carbon atoms ranges from 12 to 20, e.g., a branched chain C16 primary alcohol sulfate having 67% 2-methyl and 33% 2-ethyl branching, are known.

There is a continuing need for a branched surfactant that can improve cleaning performance at low wash temperatures, e.g., at 30° C. or even lower, at a reasonable cost and without interfering with the production and the quality of the laundry detergents in any way. Surprisingly, it has been found that the detergent compositions of the invention, which contain 2-alkyl primary alcohol alkoxy sulfates having specific alkyl chain length distributions and/or specific fractions of certain positional isomers, provide increased grease removal (particularly in cold water).

SUMMARY

The present invention attempts to solve one more of the needs by providing a detergent composition comprising from about 0.1% to about 99% by weight of the composition of a first surfactant, where the first surfactant consists essentially of a mixture of surfactant isomers of Formula I and surfactants of Formula II:

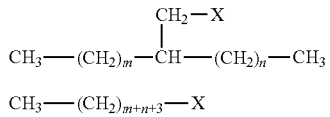

(I)

$$CH_3—(CH_2)_m—CH(CH_2—X)—(CH_2)_n—CH_3$$

(II)

$$CH_3—(CH_2)_{m+n+3}—X$$

$0 \leq m, n \leq 16$;
$8 \leq m+n \leq 16$ where from about 50% to about 100% by weight of the first surfactant are surfactants having m+n=11; where from about 0.001% to about 25% by weight of the first surfactant are surfactants of Formula II; and where X is an alkoxylated sulfate.

The detergent compositions may further comprise one or more adjunct cleaning additives.

The present invention further relates to methods of pretreating or treating a soiled fabric comprising contacting the soiled fabric with the detergent compositions of the invention.

DETAILED DESCRIPTION

Features and benefits of the present invention will become apparent from the following description, which includes examples intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein, the term "gallon" refers to a "US gallon."

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

As used to describe and/or recite the organomodified silicone element of the antifoams and consumer products comprising same herein, a 2-phenylpropylmethyl moiety is synonymous with: (methyl)(2-phenylpropyl); (2-Phenylpropyl)methyl; methyl(2-phenylpropyl); methyl(β-methylphenethyl); 2-phenylpropylmethyl; 2-phenylpropylMethyl; methyl 2-phenylpropyl; and Me 2-phenylpropyl. Thus, organomodified silicones can, by way of example, use such nomenclature as follows:

(methyl)(2-phenylpropyl)siloxane
(methyl)(2-phenylpropyl) siloxane
(2-Phenylpropyl)methylsiloxane
(2-Phenylpropyl)methyl siloxane
methyl(2-phenylpropyl)siloxane
methyl(2-phenylpropyl) siloxane
methyl(β-methylphenethyl)siloxane
methyl(β-methylphenethyl) siloxane
2-phenylpropylmethylsiloxane
2-phenylpropylmethylsiloxane
2-phenylpropylMethylsiloxane
2-phenylpropylMethylsiloxane
methyl2-phenylpropylsiloxane
methyl 2-phenylpropyl siloxane
Me 2-phenylpropylsiloxane
Me 2-phenylpropyl siloxane.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the detergent composition unless otherwise specified.

Detergent Composition

As used herein the phrase "detergent composition" or "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

Surfactant

The detergent compositions of the invention may comprise one or more surfactants.

In particular, the detergent compositions of the invention contain 2-alkyl primary alcohol ethoxy sulfates having specific alkyl chain length distributions, which provide increased grease removal (particularly in cold water). 2-alkyl branched alcohols (and the 2-alkyl branched alkyl ethoxy sulfates and other surfactants derived from them) are positional isomers, where the location of the hydroxymethyl group (consisting of a methylene bridge (—$CH_2$— unit) connected to a hydroxy (—OH) group) on the carbon chain varies. Thus, a 2-alkyl branched alcohol is generally composed of a mixture of positional isomers. Furthermore, it is well known that fatty alcohols, such as 2-alkyl branched alcohols, and surfactants are characterized by chain length distributions. In other words, fatty alcohols and surfactants are generally made up of a blend of molecules having different alkyl chain lengths (though it is possible to obtain single chain-length cuts). Notably, the 2-alkyl primary alcohols described herein, which may have specific alkyl chain length distributions and/or specific fractions of certain positional isomers, cannot be obtained by simply blending commercially available materials, such as the various ISALCHEM® alcohols, including ISALCHEM® 145 ($C_{14}$-$C_{15}$-alcohols) and ISALCHEM® 167 ($C_{16}$-$C_{17}$-alcohols). Specifically, the distribution of from about 50% to about 100% by weight surfactants having m+n=11 is not achievable by blending commercially available materials.

The detergent compositions described herein comprise from about 0.1% to about 99% by weight of the composition of a first surfactant, where the first surfactant consists essentially of a mixture of surfactant isomers of Formula I and surfactants of Formula II:

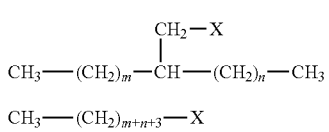

(I)

$$CH_3—(CH_2)_m—CH(CH_2—X)—(CH_2)_n—CH_3$$

(II)

$$CH_3—(CH_2)_{m+n+3}—X$$

$0 \le m, n \le 16$;
$8 \le m+n \le 16$ where from about 50% to about 100% by weight of the first surfactant are surfactants having m+n=11; where from about 0.001% to about 25% by weight of the first surfactant are surfactants of Formula II; and where X is an alkoxylated sulfate. The total concentration of surfactant isomers of Formula I and surfactants of Formula II is 100%, by weight of the first surfactant, not including impurities, such as linear and branched paraffins, linear and branched olefins, cyclic paraffins, disulfates resulting from the sulfation of any diols present, and olefin sulfonates, which may be present at low levels.

From about 55% to about 75% by weight of the first surfactant may be surfactants having m+n=11. From about 0% to about 5%, or about 0.01% to about 5%, or about 0.5% to about 3% by weight of the first surfactant may be surfactants having m+n<9. From about 0.5% to about 30% or about 1% to about 28% by weight of the first surfactant may be surfactants having m+n=10. From about 1% to about 45%, or about 5% to about 45%, or about 10% to about 45%, or about 15% to about 45%, or about 15% to about 42% by weight of the first surfactant may be surfactants having m+n=12. From about 0.1% to about 20%, or about 0.1% to about 10%, or about 0.2% to about 5%, or about 0.2% to about 3% by weight of the first surfactant may be surfactants having m+n=13. The first surfactant may comprise from about 0.001% to about 20%, or from about 0.001% to about 15%, or from about 0.001% to about 12% by weight of surfactants of Formula II. The first surfactant may comprise from about 0% to about 25%, or about 0.1% to about 20%, or about 1% to about 15%, or about 3% to about 12%, or about 5% to about 10%, by weight of surfactants of Formula II.

At least about 25% by weight of the first surfactant may be surfactants having m+n=10, m+n=11, m+n=12, and m+n=13, where n is 0, 1, or 2, or m is 0, 1, or 2. At least about 30%, or at least about 35%, or at least about 40%, by weight of the first surfactant, may be surfactants having m+n=10, m+n=11, m+n=12, and m+n=13, where n is 0, 1, or 2, or m is 0, 1, or 2. As much as about 100%, or as much as about 90%, or as much as about 75%, or as much as about 60%, by weight of the first surfactant, may be surfactants having m+n=10, m+n=11, m+n=12, and m+n=13, where n is 0, 1, or 2, or m is 0, 1, or 2.

The detergent compositions may comprise from about 0.1% to about 99% by weight of the composition of a first surfactant, where the first surfactant consists essentially of a mixture of surfactant isomers of Formula I and surfactants of Formula II:

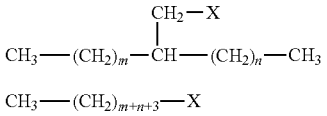

(I)

(II)

$0 \le m, n \le 16;$
$8 \le m+n \le 16$ where from about 50% to about 100% by weight of the first surfactant are surfactants having m+n=11; where from about 0.001% to about 25% by weight of the first surfactant are surfactants of Formula II; where at least about 25%, or at least about 30%, or at least about 35%, or at least about 40% by weight of the first surfactant are surfactants having m+n=10, m+n=11, m+n=12, and m+n=13, where n is 0, 1, or 2, or m is 0, 1, or 2; and where X is an alkoxylated sulfate.

The detergent compositions may comprise from about 0.1% to about 99% by weight of the composition of a first surfactant, where the first surfactant consists of a mixture of surfactant isomers of Formula I and surfactants of Formula II:

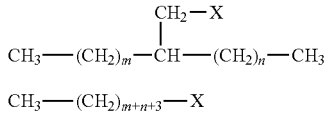

(I)

(II)

$0 \le m, n \le 16;$
$8 \le m+n \le 16$ where from about 50% to about 100% by weight of the first surfactant are surfactants having m+n=11; where from about 0.001% to about 25% by weight of the first surfactant are surfactants of Formula II; and where X is an alkoxylated sulfate.

The detergent compositions may comprise from about 0.1% to about 99% by weight of the composition of a first surfactant, where the first surfactant consists essentially of a mixture of surfactant isomers of Formula I and surfactants of Formula II:

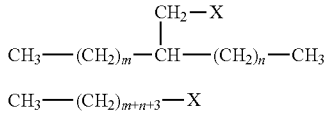

(I)

(II)

$0 \le m, n \le 16;$
$8 \le m+n \le 16$ where from about 50% to about 100% or about 55% to about 75% by weight of the first surfactant are surfactants having m+n=11; where from about 0.5% to about 30% by weight of the first surfactant are surfactants having m+n=10; where from about 1% to about 45%, or about 5% to about 45%, or about 10% to about 45%, or about 15% to about 45%, or about 15% to about 42% by weight of the first surfactant are surfactants having m+n=12; where from about 0.1% to about 20% by weight of the first surfactant are surfactants having m+n=13; where from about 0.001% to about 20% by weight of the first surfactant are surfactants of Formula II; and where X is an alkoxylated sulfate.

In Formula I and Formula II, X may be selected from an ethoxylated sulfate, a propoxylated sulfate, or mixtures thereof. X may be an ethoxylated sulfate, where the average degree of ethoxylation ranges from about 0.4 to about 5, or about 0.4 to about 3.5, or about 0.4 to about 1.5, or from about 0.6 to about 1.2, or about 2.5 to about 3.5.

The alkoxylated sulfate surfactant may exist in an acid form, and the acid form may be neutralized to form a surfactant salt. Typical agents for neutralization include metal counterion bases, such as hydroxides, e.g., NaOH, KOH, $Ca(OH)_2$, $Mg(OH)_2$, or LiOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

The detergent composition may comprise from about 0.1% to about 70% by weight of the composition of a first surfactant, where the first surfactant consists of or consists essentially of a mixture of surfactant isomers of Formula I and surfactants of Formula II, as described above. The detergent composition may comprise from about 0.1% to about 55% by weight of the composition of a first surfactant, where the first surfactant consists of or consists essentially of a mixture of surfactant isomers of Formula I and surfactants of Formula II, as described above. The detergent composition may comprise from about 1% to about 40%, or about 1% to about 25%, or about 5% to about 25%, or about 10% to about 25% by weight of the composition of a first surfactant, where the first surfactant consists of or consists essentially of a mixture of surfactant isomers of Formula I and surfactants of Formula II, as described above.

From about 0.1% to about 100% of the carbon content of the first surfactant may be derived from renewable sources. As used herein, a renewable source is a feedstock that contains renewable carbon content, which may be accessed through ASTM D6866, which allows the determination of the renewable carbon content of materials using radiocarbon analysis by accelerator mass spectrometry, liquid scintillation counting, and isotope mass spectrometry.

The detergent compositions may comprise an additional surfactant (e.g., a second surfactant, a third surfactant) selected from the group consisting of anionic surfactants, nonionic surfactants, cationic surfactants, zwitterionic surfactants, amphoteric surfactants, ampholytic surfactants, and mixtures thereof. The additional surfactant may be a detersive surfactant, which those of ordinary skill in the art will understand to encompass any surfactant or mixture of surfactants that provide cleaning, stain removing, or laundering benefit to soiled material.

Alcohol

The invention also relates to an alcohol composition containing from about 0.1% to about 99% by weight of the alcohol composition of a first alcohol, where the first alcohol consists of or consists essentially of a mixture of alcohol isomers of Formula III and alcohols of Formula IV:

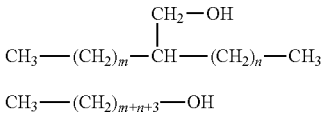

(III)

$$CH_3-(CH_2)_m-CH(CH_2-OH)-(CH_2)_n-CH_3$$

(IV)

$$CH_3-(CH_2)_{m+n+3}-OH$$

$0 \le m, n \le 16$;
$8 \le m+n \le 16$ where from about 50% to about 100% by weight of the first alcohol are alcohols having m+n=11; and where from about 0.001% to about 25% by weight of the first alcohol are alcohols of Formula IV. The total concentration of alcohol isomers of Formula III and alcohols of Formula IV is 100%, by weight of the first alcohol, not including impurities, such as linear and branched paraffins, linear and branched olefins, and cyclic paraffins, which may be present at low levels.

From about 55% to about 75% by weight of the first alcohol may be alcohols having m+n=11. From about 0.5% to about 30% by weight of the first alcohol may be alcohols having m+n=10; from about 1% to about 45%, or about 5% to about 45%, or about 10% to about 45%, or about 15% to about 45%, or about 15% to about 42%, by weight of the first alcohol may be alcohols having m+n=12; and/or from about 0.1% to about 20% by weight of the first alcohol may be alcohols having m+n=13. The first alcohol may comprise from about 0.001% to about 20%, or from about 0.001% to about 15%, or from about 0.001% to about 12% by weight of alcohols of Formula II. The first alcohol may comprise from about 0% to about 25%, or about 0.1% to about 20%, or about 1% to about 15%, or about 3% to about 12%, or about 5% to about 10%, by weight of alcohols of Formula II.

At least about 25% by weight of the first alcohol may be alcohols having m+n=10, m+n=11, m+n=12, and m+n=13, where n is 0, 1, or 2, or m is 0, 1, or 2. At least about 30%, or at least about 35%, or at least about 40%, by weight of the first alcohol, may be alcohols having m+n=10, m+n=11, m+n=12, and m+n=13, where n is 0, 1, or 2, or m is 0, 1, or 2.

The alcohol composition may contain from about 0.1% to about 99% by weight of the alcohol composition of a first alcohol, where the first alcohol consists of or consists essentially of a mixture of alcohol isomers of Formula III and alcohols of Formula IV:

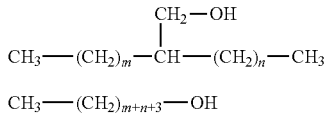

(III)

$$CH_3-(CH_2)_m-CH(CH_2-OH)-(CH_2)_n-CH_3$$

(IV)

$$CH_3-(CH_2)_{m+n+3}-OH$$

$0 \le m, n \le 16$;
$8 \le m+n \le 16$ where from about 50% to about 100%, or about 55% to about 75%, by weight of the first alcohol are alcohols having m+n=11; where from about 0.5% to about 30% by weight of the first alcohol are alcohols having m+n=10; where from about 1% to about 45%, or about 5% to about 45%, or about 10% to about 45%, or about 15% to about 45%, or about 15% to about 42% by weight of the first alcohol are alcohols having m+n=12; where from about 0.1% to about 20% by weight of the first alcohol are alcohols having m+n=13; and where from about 0.001% to about 20% by weight of the first alcohol are alcohols of Formula II.

The detergent compositions may contain from about 0.01% to about 5% by weight of the detergent composition of the alcohol compositions described above. The detergent compositions may contain from about 0.5% to about 3.0% by weight of the detergent composition of the alcohol compositions described above. At such concentrations, the alcohol compositions may provide a suds suppressing benefit to the detergent composition.

The detergent compositions may contain from about 0.01% to about 0.5% by weight of the detergent composition of the alcohol compositions described above. At such concentrations, the alcohol compositions may be impurities.

Process

The alcohols suitable for use in the present invention may be derived from lab, pilot, and commercial plant scale processes. In the pilot and commercial scale processes, the alcohols may be derived from processes that involve the hydroformylation of high purity, linear, double-bond isomerized, internal n-olefins to aldehydes and/or alcohols, where the linear, isomerized, internal n-olefins are derived from paraffins coming from kerosene/gas oil, coal, natural gas, and hydrotreated fats and oils of natural origin, e.g., animal, algal and plant oils, alcohols, methyl esters, and the like.

Extraction and purification processes are typically utilized to obtain paraffins in suitable form for dehydrogenation to olefins on a commercial plant scale. Depending on the feedstock, pretreatment fractionation may be needed as a first step in feedstock preparation, tailoring the feedstock to the desired carbon number range of the resultant n-Olefin product. Contaminant removal (sulfur, nitrogen, and oxygenates) may be accomplished, for example, by the UOP Distillate Unionfining™ process, providing a high quality feedstock. The next step is n-paraffin recovery, which may require separation of normal paraffins from branched and cyclic components. The UOP Molex™ process is an example of a liquid-state process using UOP Sorbex technology for this purpose.

The next step is the conversion of n-paraffin to n-olefins. The UOP Pacol™ process is one example of a suitable process for achieving this conversion. During the process, normal paraffins are dehydrogenated to their corresponding mono-olefins using UOP's highly active and selective DeH series of catalysts. The dehydrogenation is achieved under mild operating conditions. Other dehydrogenation processes can also be used for this purpose. Following dehydrogenation of the paraffins to olefins, it may be necessary to remove di- and poly-olefins. The UOP DeFine™ process is one example of a commercial process for this purpose. The DeFine™ process improves overall olefin yields by selectively hydrogenating di-olefins produced in the Pacol™ process into their corresponding mono-olefins. Further purification to separate the isomerized n-olefins from n-paraffins may be desirable prior to hydroformylation in order to maximize the product output in the hydroformylation step. N-olefin purification may be achieved, for example, via the UOP Olex™ process, which is a liquid-state separation of normal olefins from normal paraffins using UOP Sorbex™ technology. The olefins resulting from this process are essentially an equilibrium (thermodynamic) mixture of the isomerized n-olefins.

The isomerized linear olefins may be derived from any olefin source, such as olefins from ethylene oligomerization. If the olefin source is principally alpha-olefin, one first applies an isomerisation to obtain the equilibrium mixture of internal linear olefins.

The hydroformylation reaction (or oxo synthesis) is a reaction where aldehydes and/or alcohols are formed from olefins, carbon monoxide, and hydrogen. The reaction typically proceeds with the use of a homogenous catalyst.

For the hydroformylation of isomerized (double-bond) n-olefins to a desired high content of branched (positional isomers of 2-hydroxymethylene group along hydrocarbon backbone) aldehydes or mixture of aldehydes and alcohols, suitable catalysts are "unmodified" (no other metal ligating ligands other than CO/H), cobalt and rhodium catalysts, such as $HCo(CO)_4$, $HRh(CO)_4$, $Rh_4(CO)_{12}$ [See e.g, Applied Homogeneous Catalysis with Organometallic Compounds, Edited by Boy Comils and Wolfgang A. Herrmann, V C H, 1996 (Volume 1, Chapter 2.1.1, pp 29-104, Hydroformylation) and also Rhodium Catalysed Hydroformylation—Catalysis by Metal Complexes Volume 22, Edited by Piet W. B. N. van Leeuwen and Carmen Claver, Kluwer Academic Publishers, 2000]. Under industrially relevant conditions for application to isomerized (double bond) n-olefins, the unmodified Co catalyst may generally be used at temperatures from 80-180° C., or from 100-160° C., or from 110-150° C., and syngas ($CO/H_2$) pressures of 150-400 bar, or from 150-350 bar, or from 200-300 bar. Unmodified Rh catalysts may generally be used at temperatures from 80-180° C., or from 90-160° C., or from 100-150° C. and syngas ($CO/H_2$) pressures of 150-500 bar, or from 180 to 400 bar, or from 200 to 300 bar. In both cases the temperature and pressure ranges can be modified to tailor reaction conditions to produce the desired isomeric product specification.

Phosphite modified Rh catalysts, particularly bulky monophosphites [See, e.g. Rhodium Catalysed Hydroformylation—Catalysis by Metal Complexes Volume 22, Edited by Piet W. B. N. van Leeuwen and Carmen Claver, Kluwer Academic Publishers, 2000 (Chapter 3, pp 35-62, Rhodium Phosphite Catalysts)], which would also give the desired high content of 2-alkyl branched or "beta branched" product may also be selected.

Other modifications to the reaction scheme may include the addition of a co-solvent to the reaction system or operation under biphasic systems or other method, e.g. supported catalyst phase, to aid catalyst separation from the reaction medium.

Additional steps may be required following hydroformylation, including hydrogenation of aldehydes to alcohols, distillation of the resulting alcohols, and hydropolishing.

Depending upon which catalyst system, Co or Rh, and particular reaction conditions applied in the hydroformylation step, principally temperature and pressure, the resultant alcohol mixture of 2-alkyl branched isomers will also have a linear n-alcohol component of from about 2 to about 50% by weight. If the linear content of the resultant alcohol mixture is greater than desired, then alcohol mixture may be split via solvent or low temperature crystallization into a linear portion and branched portion, to yield a product that is rich in branched material, for example, up to about 90% by weight branched, or about 95% by weight branched, or even 99% by weight branched.

The desired alkyl chain length distribution of the alcohol composition (e.g., from about 50% to about 100% by weight of the composition are C15 alcohols (m+n=11, Formula III)), may be obtained by blending different chain length materials at various stages of the process, for example, different chain length paraffins may be blended prior to dehydrogenation, different chain length olefins may be blended prior to hydroformylation, different chain length aldehydes may be blended following hydroformylation, or different chain length alcohols may be blended after the step of reducing the aldehydes to alcohols.

The invention also relates to a process for preparing an alcohol composition comprising the steps of:

a. providing internal olefins having from about 11 to about 19, or about 13 to about 16, carbon atoms;

b. hydroformylating said internal olefins with an unmodified rhodium catalyst or a cobalt catalyst, typically unmodified, to produce aldehydes having from about 12 to about 20, or about 14 to about 17, carbon atoms;

c. hydrogenating the aldehydes of step (b) to generate the alcohol composition;

d. optionally separating linear alcohols from branched alcohols via solvent or low-temperature recrystallization, such that the alcohol composition is less than 10% by weight linear alcohols.

The resulting alcohol compositions may be further processed to produce surfactant compositions. For example, conventional conversion of the resulting alcohol compositions into anionic surfactants, such as alkyl sulfates or alkoxylated sulfate surfactants, e.g., ethoxylated sulfate surfactants, is described in "Anionic Surfactants-Organic Chemistry", Volume 56 of the Surfactant Science Series, Marcel Dekker, New York. 1996.

Alkoxylation is a process that reacts lower molecular weight epoxides (oxiranes), such as ethylene oxide, propylene oxide, and butylene oxide. These epoxides are capable of reacting with an alcohol using various base or acid catalysts. In base catalyzed alkoxylation, an alcoholate anion, formed initially by reaction with a catalyst (alkali metal, alkali metal oxide, carbonate, hydroxide, or alkoxide), nucleophilically attacks the epoxide.

Traditional alkaline catalysts for alkoxylation include KOH and NaOH. These catalysts give a somewhat broader distribution of alkoxylates. When ethoxylation is conducted with these catalysts, the term broad range ethoxylation or BRE is often applied.

Other catalysts have been developed for alkoxylation that give a more narrow distribution of alkoxylate oligomers. When alkoxylation is conducted with these catalysts, the terms narrow range alkoxylation, narrow range ethoxylation, or NRE, and peaked alkoxylation and peaked ethoxylation are often used to describe the process and materials produced. Examples of narrow range alkoxylation catalysts include many alkaline earth (Mg, Ca, Ba, Sr, etc.) derived catalysts, Lewis acid catalysts, such as Zirconium dodecanoxide sulfate, and certain boron halide catalysts, such as those decribed by Dupont and of the form $MB(OR^1)_x(X)_{4-x}$ or $B(OR^1)_3/MX$ wherein $R^1$ is a linear, branched, cyclic, or aromatic hydrocarbyl group, optionally substituted, having from 1 to 30 carbon atoms, M is $Na^+$, $K^+$, $Li^+$, $R^2R^3R^4R^5N^+$, or $R^2R^3R^4R^5P^+$, where $R^2$, $R^3$, $R^4$, and $R^5$ independently are hydrocarbyl groups, and x is 1 to 3.

With regard to alkoxylation, it is known that alkoxylation reactions such as, for example, the addition of n mol of ethylene oxide onto 1 mol of fatty alcohol, by known ethoxylation processes, do not give a single adduct, but rather a mixture of residual quantities of free fatty alcohol and a number of homologous (oligomeric) adducts of 1, 2, 3, . . . n, n+1, n+2 molecules of ethylene oxide per molecule of fatty alcohol. The average degree of ethoxylation (n) is defined by the starting quantities of fatty alcohol and ethylene oxide and may be a fractional number.

A specific average degree of alkoxylation may be achieved by selecting the starting quantities of fatty alcohol and ethylene oxide (targeted) or by blending together varying amounts of alkoxylated surfactants differing from one another by 1 or more in average degree of alkoxylation. For example, if the average degree of alkoxylation for a particular surfactant is 3.5, then the surfactant may be comprised of a mixture of surfactants, in which approximately equal molar amounts of surfactants having a degree of alkoxylation of 3.0 and surfactants having a degree of alkoxylation 4.0 are blended together. And, each of the surfactants that is in the blend may itself contain small amounts of species having average degrees of ethoxylation greater than or less than the average numbers, such that the resultant blend may comprise mixtures of surfactants with degrees of ethoxylation varying over a range of 2 or 3 or more units.

Impurities

The process of making the 2-alkyl primary alcohol-derived surfactants of the invention may produce various impurities and/or contaminants at different steps of the process. For example, as noted above, during the process of obtaining n-paraffins, contaminants, such as sulfur, nitrogen, and oxygenates, as well as impurities, such as branched and cyclic components, may be formed. Such impurities and contaminants are typically removed. During the conversion of n-paraffin to n-olefins, di- and poly-olefins may be formed and may optionally be removed. And, some unreacted n-paraffins may be present after the conversion step; these n-paraffins may or may not be removed prior to subsequent steps. The step of hydroformylation may also yield impurities, such as linear and branched paraffins (arising from paraffin impurity in the olefin feed or formed in the hydroformylation step), residual olefin from incomplete hydroformylation, as well as esters, formates, and heavy-ends (dimers, trimers) Impurities that are not reduced to alcohol in the hydrogenation step may be removed during the final purification of the alcohol by distillation.

Also, it is well known that the process of sulfating fatty alcohols to yield alkyl sulfate surfactants also yields various impurities. The exact nature of these impurities depends on the conditions of sulfation and neutralization. Generally, however, the impurities of the sulfation process include one or more inorganic salts, unreacted fatty alcohol, and olefins ("The Effect of Reaction By-Products on the Viscosities of Sodium Lauryl Sulfate Solutions," *Journal of the American Oil Chemists' Society*, Vol. 55, No. 12, p. 909-913 (1978), C. F. Putnik and S. E. McGuire).

Alkoxylation impurities may include dialkyl ethers, polyalkylene glycol dialkyl ethers, olefins, and polyalkylene glycols Impurities can also include the catalysts or components of the catalysts that are used in various steps.

SYNTHESIS EXAMPLES

The following examples are representative and non-limiting.

Alcohol Compositions—Using the above-described process (MOLEX, PACOL, DEFINE, OLEX and either cobalt (Examples 1, 6) or unmodified Rh hydroformylation (Examples 2-5) with subsequent finishing and purification steps, the alcohol compositions of Examples 1-6 are obtained and in Examples 2-6 analyzed by gas chromatography with mass selection detection and flame ionization detection (GC MSD/FID). The samples are prepared as a 1% (v/v) dichloromethane solution and 1 μl of each sample is injected in a Capillary GC Column: DB-5MS 30 m×0.25 mm ID, 0.25 μm film using an oven program of [50° C. (2 min)–(10° C./min)–285° C. (5 min)] for 30.5 minutes. Additional parameters include Column Flow: 1.2 ml/min (He), Average Velocity 40 cm/sec, Injection Temp: 280° C., Sample Amount: 1 μl, Split Ratio: 1/100, FID Temp: 300° C., H2 Flow: 40 ml/min, Air Flow: 450 ml/min, and Makeup Gas Flow: 25 ml/min (He). Results are an average of two separate injections and chromatographic analyses.

Example 1

Preparation of Isalchem 145 EO 1 Sulfate

Commercially available Isalchem 145 alcohol was ethoxylated by Sasol using potassium hydroxide to an ethoxylate level of 1.0.

A 3-Liter, 3-neck, round bottom flask is equipped with a magnetic stir bar for mixing, an addition funnel with an nitrogen gas feed in the center neck, a thermometer in one side neck and a tubing vent line in the other side neck leading to a gas bubbler filled with 1 Normal concentration Sodium Hydroxide to trap HCl gas evolved from reaction. 567 grams of the Isalchem 145 Alcohol Ethoxylate (1-mole) Composition and 600 milliliters of ACS Reagent Grade Diethyl Ether is added to the round bottom flask. 261 grams of 98.5% Chlorosulfonic Acid is added to addition funnel. An nitrogen gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature between 10 and 15° C.

The Chlorosulfonic Acid addition is complete in 85 minutes. Reaction mixture is clear and nearly colorless. The Ice/NaCl/Water bath is replaced with a warm water bath. The vent line tube attached to the Sodium Hydroxide bubbler is switched to a vacuum tube attached to a water aspirator. The reaction mixture is placed under full vacuum for 2 hours at 20° C. With good vortex mixing using an overhead mixer with stainless steel mixing blades, slowly pour reaction mixture into a mixture of 532 grams of 25 wt % Sodium Methoxide solution in methanol and 1250 milliliters of ACS Reagent Grade Methanol contained in a stainless steel beaker cooled with an ice/water bath to convert the acid sulfate form to the sodium sulfate salt form. Additional sodium methoxide is added to adjust the pH to between 9 to 10 by measurement with pH test strips. Reaction product is poured into a flat stainless steel pan in a fume hood. Product is allowed to dry for 48 hours yielding a white solid waxy material. Product is transferred in equal amounts to a vacuum oven under full vacuum and room temperature to remove residual solvent for approximately 48 hours. The product is occasionally removed from vacuum oven and mixed with spatula to create fresh surface area to aid in solvent removal. 798 grams of a white, waxy solid product is recovered and analyzed by standard Cationic SO3 titration method which determined final product activity to be 94.1%.

Example 2

C14-Rich (Formula III, m+n=10) 2-Alkyl Primary Alcohol Composition

TABLE 1

C14-rich 2-alkyl primary Alcohol - Composition

| Carbon# | Branch Location | Normalized FID Area % | Sub Total |
|---|---|---|---|
| C14 | Linear | 8.2 | 94.9 |
| | 2-Methyl | 19.0 | |
| | 2-Ethyl | 12.7 | |
| | 2-Propyl | 13.8 | |
| | 2-Butyl | 15.8 | |
| | 2-Pentyl+ | 25.4 | |
| C15 | Linear | 0.1 | 5.1 |
| | 2-Methyl | 0.8 | |
| | 2-Ethyl | 0.5 | |
| | 2-Propyl | 0.8 | |
| | 2-Butyl | 0.9 | |
| | 2-Pentyl+ | 2.0 | |
| Total FID Area % | | 100 | 100 |

Example 3

C15-Rich (Formula III, m+n=11) 2-Alkyl Primary Alcohol Composition

TABLE 2

C15-rich 2-alkyl primary Alcohol - Composition

| Carbon# | Branch Location | Normalized FID Area % | Sub Total |
|---|---|---|---|
| C15 | Linear | 8.6 | 98.1 |
| | 2-Methyl | 19.0 | |
| | 2-Ethyl | 12.0 | |
| | 2-Propyl | 12.7 | |
| | 2-Butyl | 14.6 | |
| | 2-Pentyl+ | 31.2 | |
| C16 | Linear | 0.0 | 1.9 |
| | 2-Methyl | 0.2 | |
| | 2-Ethyl | 0.1 | |
| | 2-Propyl | 0.3 | |
| | 2-Butyl | 0.4 | |
| | 2-Pentyl+ | 0.9 | |
| Total FID Area % | | 100 | 100 |

Example 4

C16-Rich (Formula III, m+n=12) 2-Alkyl Primary Alcohol Composition

TABLE 3

C16-rich 2-alkyl primary Alcohol - Composition

| Carbon# | Branch Location | Normalized FID Area % | Sub Total |
|---|---|---|---|
| C14 | Linear | 0.1 | 0.7 |
| | 2-Methyl | 0.2 | |
| | 2-Ethyl | 0.1 | |
| | 2-Propyl | 0.1 | |
| | 2-Butyl | 0.1 | |
| | 2-Pentyl+ | 0.1 | |
| C15 | Linear | 0.7 | 5.5 |
| | 2-Methyl | 1.3 | |
| | 2-Ethyl | 0.7 | |
| | 2-Propyl | 0.7 | |
| | 2-Butyl | 0.7 | |
| | 2-Pentyl+ | 1.4 | |
| C16 | Linear | 7.6 | 93.8 |
| | 2-Methyl | 16.0 | |
| | 2-Ethyl | 10.1 | |
| | 2-Propyl | 10.9 | |
| | 2-Butyl | 13.0 | |
| | 2-Pentyl+ | 36.2 | |
| Total FID Area % | | 100 | 100 |

Example 5

A C14/C15/C16 2-alkyl primary alcohol composition is prepared by blending 557.50 g of the C14-rich 2-alkyl primary alcohol composition of Example 2, 1256.73 g of the C15-rich 2-alkyl primary alcohol composition of Example 3, and 313.65 g of the C16-rich 2-alkyl primary alcohol composition of Example 4.

TABLE 4

| C14, C15, C16 2-alkyl primary alcohol Composition | | | |
|---|---|---|---|
| Carbon# | Isomer | Normalized FID Area % | Sub Total |
| C14 | Linear | 2.14 | 24.9 |
| | 2-Methyl | 4.98 | |
| | 2-Ethyl | 3.36 | |
| | 2-Propyl | 3.60 | |
| | 2-Butyl | 4.19 | |
| | 2-Pentyl+ | 6.62 | |
| C15 | Linear | 5.32 | 60.3 |
| | 2-Methyl | 11.6 | |
| | 2-Ethyl | 7.37 | |
| | 2-Propyl | 7.80 | |
| | 2-Butyl | 9.00 | |
| | 2-Pentyl+ | 19.2 | |
| C16 | Linear | 1.05 | 14.8 |
| | 2-Methyl | 2.53 | |
| | 2-Ethyl | 1.51 | |
| | 2-Propyl | 1.82 | |
| | 2-Butyl | 2.13 | |
| | 2-Pentyl+ | 5.74 | |

Preparation of a C14/C15/C16 2-Alkyl Alkanol Sulfate 704.9 grams of the above C14/C15/C16 2-Alkyl Primary Alcohol Composition and 700 milliliters of ACS Reagent Grade Diethyl Ether are added to a 3-Liter, 3-neck, round bottom flask. The flask is equipped with a magnetic stir bar for mixing, an addition funnel with an argon gas feed in the center neck, a thermometer in one side neck and a tubing vent line in the other side neck leading to a gas bubbler filled with 1 Normal concentration Sodium Hydroxide to trap HCl gas evolved from reaction. 378.90 grams of 98.5% Chlorosulfonic Acid are added to addition funnel. An argon gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 64 minutes. Reaction mixture is clear and nearly colorless. The Ice/NaCl/Water bath is replaced with a 22-23° C. water bath. The vent line tube attached to the Sodium Hydroxide bubbler is switched to a vacuum tube attached to a water aspirator. A solvent trap cooled with a Dry Ice/Isopropanol bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 18 minutes under argon gas sweep while exchanging the water baths and setting up the vacuum system during which time the reaction mixture warms from 9° C. to 16° C. With continued mixing, turn on aspirator to begin applying vacuum on the reaction mixture. Slowly increase the vacuum level by incrementally slowing the Argon gas flow from addition funnel. This is done to control foaming of the reaction mixture. Eventually the Argon flow is completely stopped resulting in full vacuum applied to the reaction mixture (30 inches of Hg on the vacuum gauge indicating full vacuum applied). Full vacuum is reached after 51 minutes of incrementally increasing vacuum. The reaction mixture is held under full vacuum for 61 minutes at which point the reaction mixture is 13° C., gold in color, clear, fluid and mixing well with very little bubbling observed.

With good vortex mixing using an overhead mixer with stainless steel mixing blades, the reaction mixture is slowly poured over approximately a 10 minute period into a mixture of 772.80 grams of 25 wt % Sodium Methoxide solution in methanol and 1250 milliliters of ACS Reagent Grade Methanol contained in a stainless steel beaker cooled with an ice/water bath to convert the C14, C15, C16 2-Alkyl Primary Alcohol Sulfate Composition reaction product from the acid sulfate form to the sodium sulfate salt form. The resulting mixture is cloudy, pale yellow in color, fluid and mixing well. Dissolve approximately 0.1 grams of the reaction product in 0.25-0.5 grams of DI water and measure pH to be 12 using a pH test strip. Let mix for an additional 20 minutes and then store reaction product overnight in a sealed plastic bucket in refrigerator at 4.5° C. Reaction product is poured into a flat stainless steel pan in a fume hood. Product is allowed to dry overnight yielding a soft solid. Product is transferred in equal amounts to three smaller pans and spread into thin layers and placed in a vacuum oven (4-5 mm Hg internal pressure, 22-23° C.) to remove residual solvent for approximately 185 hours. The product is occasionally removed from vacuum oven and mixed with spatula to create fresh surface area to aid in solvent removal. An off-white, soft solid product is recovered. Final product is analyzed by standard Cationic SO3 titration method and final product activity is determined to be 90.8%.

Example 6

A C14/C15/C16-rich 2-alkyl alkanol composition was prepared from a C13, C14, C15 linear internal olefin mixture using a cobalt catalyst to hydroformylate the olefin mixture to an aldehyde mixture. The resulting aldehyde mixture was reduced to the corresponding alcohol mixture by hydrogenation. The linear alcohol portion of the mixture was reduced to the levels shown in the table below using a low temperature crystallization procedure.

TABLE 5

| C14, C15, C16-rich 2-alkyl primary alcohol Composition | | | |
|---|---|---|---|
| Carbon# | Isomer | Normalized FID Area % | Sub Total |
| <C14 | Linear and 2-alkyl | 1.05 | 1.1 |
| C14 | Linear | 3.63 | 25.4 |
| | 2-Methyl | 5.08 | |
| | 2-Ethyl | 2.95 | |
| | 2-Propyl | 3.29 | |
| | 2-Butyl | 3.95 | |
| | 2-Pentyl+ | 6.48 | |
| C15 | Linear | 4.79 | 61.4 |
| | 2-Methyl | 10.81 | |
| | 2-Ethyl | 6.56 | |
| | 2-Propyl | 7.71 | |
| | 2-Butyl | 9.56 | |
| | 2-Pentyl+ | 22.02 | |
| C16 | Linear | 0.68 | 12.1 |
| | 2-Methyl | 1.66 | |
| | 2-Ethyl | 1.07 | |
| | 2-Propyl | 1.35 | |
| | 2-Butyl | 1.81 | |
| | 2-Pentyl+ | 5.55 | |

Example 7

Preparation of a C14/C15/C16 2-Alkyl Alkanol Ethoxylate (3-Mole) Sulfate

The alcohol of Example 6 is ethoxylated using a potassium hydroxide catalyst to an average level of 3.0 moles of ethylene oxide adduct per mole of starting alcohol.

128.40 grams of the above C14/C15/C16 2-Alkyl Primary Alcohol ethoxylate (3-mole) composition and 135 milliliters of ACS Reagent Grade Diethyl Ether are added to a 1-Liter, 3-neck, round bottom flask. The flask is equipped with a magnetic stir bar for mixing, an addition funnel with an argon gas feed in the center neck, a thermometer in one side neck and a tubing vent line in the other side neck leading to a gas bubbler filled with 1 Normal concentration Sodium Hydroxide to trap HCl gas evolved from reaction. 45.07 grams of 98.5% Chlorosulfonic Acid is added to addition funnel. An argon gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 39 minutes. Reaction mixture is slightly cloudy and nearly colorless. The Ice/NaCl/Water bath is replaced with a 22° C. water bath. The vent line tube attached to the Sodium Hydroxide bubbler is switched to a vacuum tube attached to a water aspirator. A solvent trap cooled with a Dry Ice/Isopropanol bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 15 minutes under argon gas sweep while exchanging the water baths and setting up the vacuum system.

With continued mixing, turn on aspirator to begin applying vacuum on the reaction mixture. Slowly increase the vacuum level by incrementally slowing the Argon gas flow from addition funnel. This is done to control foaming of the reaction mixture. Eventually the Argon flow is completely stopped resulting in full vacuum applied to the reaction mixture (30 inches of Hg on the vacuum gauge indicating full vacuum applied). Full vacuum is reached after 17 minutes of incrementally increasing vacuum. The reaction mixture is held under full vacuum for 8 minutes at which point the reaction mixture is 7.5° C. Broke vacuum with argon gas flow, added an additional 25 ml of Diethyl Ether and began incrementally increasing vacuum as done above. Full vacuum was again reached after 16 minutes and held there for 8 minutes at which point the reaction mixture was 18° C. Broke vacuum with argon gas flow, added an additional 25 ml of Diethyl Ether and began incrementally increasing vacuum as done above. Full vacuum was again reached after 22 minutes and held there for 29 minutes at which point the reaction mixture was 19.5° C., gold in color, clear, somewhat viscous with very little bubbling observed.

With good vortex mixing using an overhead mixer with stainless steel mixing blades, slowly pour reaction mixture over approximately a 2-3 minute period into a mixture of 93.84 grams of 25 wt % Sodium Methoxide solution in methanol and 350 milliliters of ACS Reagent Grade Methanol contained in a stainless steel beaker cooled with an ice/water bath to convert the C14/C15/C16 2-Alkyl Primary Alcohol Ethoxylate (3-mole) Sulfate Composition reaction product from the acid sulfate form to the sodium sulfate salt form. The resulting mixture is milky white, fluid and mixing well. Dissolve approximately 0.1 grams of the reaction product in 0.25-0.5 grams of DI water and measure pH to be 12 using a pH test strip. Let mix for an additional 15 minutes.

Reaction product is poured into a flat glass dish in a fume hood. Product is allowed to dry overnight yielding a soft solid. Product is transferred in equal amounts to two 1200 ml glass flasks and spread into thin layers. The flasks are placed in a −18° C. freezer for 2 hours and then attached to a LABCONCO Freeze Drying unitunder vacuum (4-5 mm Hg internal pressure) to remove residual solvent for 48 hours. 164.3 grams of an off-white, tacky solid product is recovered. Final product is determined to be 90.25% active by standard Cationic SO3 titration analysis.

Example 8

Preparation of a C14/C15/C16 2-Alkyl Alkanol Ethoxylate (1-Mole) Sulfate

1% (wt/wt) solutions of Example 5 and Example 7 are prepared. Aliquots of the 1% solutions are mixed in the following proportions: 884 ul of Example 5 to 616 ul of Example 7.

Example 9

Preparation of a C14/C15/C16 2-Alkyl Alkanol Ethoxylate (1.0-Mole) Sulfate

The alcohol from Example 6 is ethoxylated by Sasol using their proprietary Novel™ catalyst to an ethoxylate level of 1.0.

91.14 grams of the resulting C14/C15/C16 2-Alkyl Primary Alcohol ethoxylate (1.0-mole) composition and 125 milliliters of ACS Reagent Grade Diethyl Ether are added to a 1-Liter, 3-neck, round bottom flask. The flask is equipped with a magnetic stir bar for mixing, an addition funnel with an argon gas feed in the center neck, a thermometer in one side neck and a tubing vent line in the other side neck leading to a gas bubbler filled with 1 Normal concentration Sodium Hydroxide to trap HCl gas evolved from reaction. 40.97 grams of 98.5% Chlorosulfonic Acid is added to addition funnel. An argon gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 28 minutes. Reaction mixture is slightly cloudy and nearly colorless. The Ice/NaCl/Water bath is replaced with a 22° C. water bath. The vent line tube attached to the Sodium Hydroxide bubbler is switched to a vacuum tube attached to a water aspirator. A solvent trap cooled with a Dry Ice/Isopropanol bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 29 minutes under argon gas sweep while exchanging the water baths and setting up the vacuum system during which time the reaction mixture warms from 6° C. to 19° C.

With continued mixing, turn on aspirator to begin applying vacuum on the reaction mixture. Slowly increase the vacuum level by incrementally slowing the Argon gas flow from addition funnel. This is done to control foaming of the reaction mixture. Eventually the Argon flow is completely stopped resulting in full vacuum applied to the reaction mixture (30 inches of Hg on the vacuum gauge indicating full vacuum applied). Full vacuum is reached after 23 minutes of incrementally increasing vacuum. The reaction mixture is held under full vacuum for 13 minutes at which point the reaction mixture is 14° C. Broke vacuum with argon gas flow, added an additional 25 ml of Diethyl Ether and began incrementally increasing vacuum as done above. Full vacuum was again reached after 11 minutes and held there for 14 minutes at which point the reaction mixture was 14° C. Broke vacuum with argon gas flow, added an additional 25 ml of Diethyl Ether and began incrementally increasing vacuum as done above. Full vacuum was again reached after 11 minutes and held there for 26 minutes at which point the reaction mixture was 16° C., gold in color, clear and fluid with very little bubbling observed.

With good vortex mixing using an overhead mixer with stainless steel mixing blades, slowly pour reaction mixture over approximately a 2-3 minute period into a mixture of 83.56 grams of 25 wt % Sodium Methoxide solution in methanol and 350 milliliters of ACS Reagent Grade Methanol contained in a stainless steel beaker cooled with an ice/water bath to convert the C14/C15/C16 2-Alkyl Primary Alcohol Ethoxylate (1.0-mole) Sulfate Composition reaction product from the acid sulfate form to the sodium sulfate salt form. The resulting mixture is milky white, fluid and mixing well. Dissolve approximately 0.1 grams of the reaction product in 0.25-0.5 grams of DI water and measure pH to be 12 using a pH test strip. Let mix for an additional 15 minutes.

Reaction product is poured into a flat glass dish in a fume hood. Product is allowed to dry overnight yielding a soft solid. Product is transferred in equal amounts to two 1200 ml glass flasks and spread into thin layers. The flasks are placed in a −18° C. freezer for 2 hours and then attached to a LABCONCO Freeze Drying unitunder vacuum (4-5 mm Hg internal pressure) to remove residual solvent for 72 hours. 122.6 grams of an off-white, tacky solid product is recovered.

Final product is determined to be 94.98% active by standard Cationic SO3 titration analysis.

Example 10

Preparation of a C14/C15/C16 2-Alkyl Alkanol Ethoxylate (3.1-Mole) Sulfate

The alcohol from Example 6 is ethoxylated by Sasol using their proprietary Novel™ catalyst to an ethoxylate level of 3.1.

115.56 grams of the resulting C14/C15/C16 2-Alkyl Primary Alcohol ethoxylate (3.1-mole) composition and 125 milliliters of ACS Reagent Grade Diethyl Ether are added to a 1-Liter, 3-neck, round bottom flask. The flask is equipped with a magnetic stir bar for mixing, an addition funnel with an argon gas feed in the center neck, a thermometer in one side neck and a tubing vent line in the other side neck leading to a gas bubbler filled with 1 Normal concentration Sodium Hydroxide to trap HCl gas evolved from reaction. 38.65 grams of 98.5% Chlorosulfonic Acid is added to addition funnel. An argon gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 26 minutes. Reaction mixture is slightly cloudy and nearly colorless. The Ice/NaCl/Water bath is replaced with a 22° C. water bath. The vent line tube attached to the Sodium Hydroxide bubbler is switched to a vacuum tube attached to a water aspirator. A solvent trap cooled with a Dry Ice/Isopropanol bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 14 minutes under argon gas sweep while exchanging the water baths and setting up the vacuum system during which time the reaction mixture warms from 9.5° C. to 18.5° C.

With continued mixing, turn on aspirator to begin applying vacuum on the reaction mixture. Slowly increase the vacuum level by incrementally slowing the Argon gas flow from addition funnel. This is done to control foaming of the reaction mixture. Eventually the Argon flow is completely stopped resulting in full vacuum applied to the reaction mixture (30 inches of Hg on the vacuum gauge indicating full vacuum applied). Full vacuum is reached after 24 minutes of incrementally increasing vacuum. The reaction mixture is held under full vacuum for 14 minutes at which point the reaction mixture is 16° C. Broke vacuum with argon gas flow, added an additional 25 ml of Diethyl Ether and began incrementally increasing vacuum as done above. Full vacuum was again reached after 13 minutes and held there for 7 minutes at which point the reaction mixture was 12.5° C. Broke vacuum with argon gas flow, added an additional 25 ml of Diethyl Ether and began incrementally increasing vacuum as done above. Full vacuum was again reached after 20 minutes and held there for 20 minutes at which point the reaction mixture was 16° C., gold in color, slightly cloudy, viscous with very little bubbling observed.

With good vortex mixing using an overhead mixer with stainless steel mixing blades, slowly pour reaction mixture over approximately a 2-3 minute period into a mixture of 78.84 grams of 25 wt % Sodium Methoxide solution in methanol and 350 milliliters of ACS Reagent Grade Methanol contained in a stainless steel beaker cooled with an ice/water bath to convert the C14/C15/C16 2-Alkyl Primary Alcohol Ethoxylate (3.1-mole) Sulfate Composition reaction product from the acid sulfate form to the sodium sulfate salt form. The resulting mixture is milky white, fluid and mixing well. Dissolve approximately 0.1 grams of the reaction product in 0.25-0.5 grams of DI water and measure pH to be 12 using a pH test strip. Let mix for an additional 15 minutes.

Reaction product is poured into a flat glass dish in a fume hood. Product is allowed to dry three days yielding a very viscous paste. Product is transferred in equal amounts to two flat glass dishes and spread into thin layers and placed in a vacuum oven (4-5 mm Hg internal pressure, 22-23° C.) to remove residual solvent for 72 hours. 129.7 grams of an off-white, very viscous pasty product is recovered. Final product is determined to be 95.30% active by standard Cationic SO3 titration analysis.

Example 11

Preparation of a C14/C15/C16 2-Alkyl Alkanol Ethoxylate (1.0-Mole) Sulfate

1% (wt/wt) solutions of Example 5 and Example 10 are prepared. Aliquots of the 1% solutions are mixed in the following proportions: 836 ul of Example 5 to 664 ul of Example 10.

Example 12

Preparation of a C15 Rich 2-Alkyl Alkanol Ethoxylate (1.0-Mole) Sulfate

The ethoxylation reactor used is a Model Number 4572 Parr 1800 ml reactor constructed of T316 stainless steel. It has a Magnetic Drive stirring assembly that uses an electric motor for agitation. The stir shaft has 2 each pitched blade impellers. The reactor has a cooling coil and water is used in the cooling coil to keep the temperature from exceeding a programmed setpoint. The reactor is monitored and controlled by a Camile data acquisition and control system along with the connected automated control valves and other devices.

1286.00 g of C15 rich 2-Alkyl Primary Alcohol composition from example 3 is added to the reactor along with 3.115 g of 46.6% active KOH solution in water. The reactor is purged of air using vacuum and nitrogen cycles. Water is removed by sparging with nitrogen. This is done by adding a trickle of nitrogen through the drain valve located on the bottom of the reactor while using a water aspirator for a vacuum source and adjusting the reactor temperature to ~110° C. and while keeping the reactor pressure below −12 psig by adjusting the nitrogen flow rate. After 2 hours the nitrogen sparge is stopped and the reactor is filled with nitrogen from above and then vented off to ~0 psig. The reactor is closed off and then heated to between 110 and 120° C. with the agitator stir rate adjusted to ~250 rpm (used throughout). 123.88 grams of Ethylene oxide is slowly added to the reactor using automated control valves. The addition of ethylene oxide causes the reactor temperature to increase but this is managed by automated cooling water while controlling the rate at which the ethylene oxide is added. The total pressure is kept below 200 psig until all the ethylene oxide is added. The reaction is allowed to run for a total of about 1.5 hours. During this time, the pressure from the ethylene oxide slowly drops as it is consumed by the reaction and eventually the pressure levels off and is constant for ~30 minutes.

Residual ethylene oxide is removed by sparging with nitrogen while using a water aspirator for a vacuum source. During this procedure, the reactor temperature is kept at ~110° C. and the reactor pressure is kept below −12 psig. After 30 minutes, the reactor is cooled to 50° C. and a 522.10 g sample of C15 rich 2-Alkyl Primary Alcohol 0.5 Mole Ethoxylate is drained from the reactor to a glass jar while keeping the sample blanketed with low pressure nitrogen. The reactor is closed off after collection of the sample. Based on mass balance calculations, 887.78 g of C15 rich 2-Alkyl Primary Alcohol 0.5 Mole Ethoxylate remains in the reactor.

The reactor heated to between 110 and 120° C. with the agitator stir rate adjusted to ~250 rpm (used throughout) and 78.01 grams of Ethylene oxide is slowly added to the reactor using automated control valves. The addition of ethylene oxide causes the reactor temperature to increase but this is managed by automated cooling water while controlling the rate at which the ethylene oxide is added. The total pressure is kept below 200 psig until all the ethylene oxide is added. The reaction is allowed to run for a total of about 1.5 hours. During this time, the pressure from the ethylene oxide slowly drops as it is consumed by the reaction and eventually the pressure levels off and is constant for ~30 minutes.

Residual ethylene oxide is removed by sparging with nitrogen while using a water aspirator for a vacuum source. During this procedure, the reactor temperature is kept at ~110° C. and the reactor pressure is kept below −12 psig. After 30 minutes, the reactor is cooled to 50° C. and based on mass balance calculation, 965.79 g of C15 rich 2-Alkyl Primary Alcohol 1 Mole Ethoxylate is contained in the reactor for drainage to a glass jar while keeping the sample blanketed with low pressure nitrogen.

95.91 grams of the above C15 rich 2-Alkyl Primary Alcohol ethoxylate (1-mole) composition and 135 milliliters of ACS Reagent Grade Diethyl Ether are added to a 1-Liter, 3-neck, round bottom flask. The flask is equipped with a magnetic stir bar for mixing, an addition funnel with an argon gas feed in the center neck, a thermometer in one side neck and a tubing vent line in the other side neck leading to a gas bubbler filled with 1 Normal concentration Sodium Hydroxide to trap HCl gas evolved from reaction. 42.87 grams of 98.5% Chlorosulfonic Acid is added to addition funnel. An argon gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 31 minutes. Reaction mixture is slightly cloudy and nearly colorless. The Ice/NaCl/Water bath is replaced with a 22° C. water bath. The vent line tube attached to the Sodium Hydroxide bubbler is switched to a vacuum tube attached to a water aspirator. A solvent trap cooled with a Dry Ice/Isopropanol bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 15 minutes under argon gas sweep while exchanging the water baths and setting up the vacuum system.

With continued mixing, turn on aspirator to begin applying vacuum on the reaction mixture. Slowly increase the vacuum level by incrementally slowing the Argon gas flow from addition funnel. This is done to control foaming of the reaction mixture. Eventually the Argon flow is completely stopped resulting in full vacuum applied to the reaction mixture (30 inches of Hg on the vacuum gauge indicating full vacuum applied). Full vacuum is reached after 24 minutes of incrementally increasing vacuum. The reaction mixture is held under full vacuum for 10 minutes at which point the reaction mixture is 11° C. Broke vacuum with argon gas flow, added an additional 25 ml of Diethyl Ether and began incrementally increasing vacuum as done above. Full vacuum was again reached after 10 minutes and held there for 9 minutes at which point the reaction mixture was 11° C. Broke vacuum with argon gas flow, added an additional 25 ml of Diethyl Ether and began incrementally increasing vacuum as done above. Full vacuum was again reached after 11 minutes and held there for 31 minutes at which point the reaction mixture was 15.5° C., gold in color, clear and fluid with very little bubbling observed.

With good vortex mixing using an overhead mixer with stainless steel mixing blades, slowly pour reaction mixture over approximately a 2-3 minute period into a mixture of 89.22 grams of 25 wt % Sodium Methoxide solution in methanol and 350 milliliters of ACS Reagent Grade Methanol contained in a stainless steel beaker cooled with an ice/water bath to convert the C15 rich 2-Alkyl Primary Alcohol Ethoxylate (1-mole) Sulfate Composition reaction product from the acid sulfate form to the sodium sulfate salt form. The resulting mixture is milky white, fluid and mixing well. Dissolve approximately 0.1 grams of the reaction product in 0.25-0.5 grams of DI water and measure pH to be 12 using a pH test strip. Let mix for an additional 15 minutes. Reaction product is poured into a flat glass dish in a fume hood. Product is allowed to dry overnight yielding a soft solid. Product is transferred in equal amounts to two 1200 ml glass flasks and spread into thin layers. The flasks are placed in a −18° C. freezer for 2 hours and then attached to a LABCONCO Freeze Drying unit under vacuum (4-5 mm Hg internal pressure) to remove residual solvent for 72 hours. 131.6 grams of an off-white, slightly tacky solid product is recovered. Final product is determined to be 94.09% active by standard Cationic SO3 titration analysis.

Example 13

Preparation of a C16 Rich 2-Alkyl Alkanol Ethoxylate (1.0-Mole) Sulfate

The ethoxylation reactor used is a Model Number 4572 Parr 1800 ml reactor constructed of T316 stainless steel. It has a Magnetic Drive stirring assembly that uses an electric motor for agitation. The stir shaft has 2 each pitched blade impellers. The reactor has a cooling coil and water is used in the cooling coil to keep the temperature from exceeding a programmed setpoint. The reactor is monitored and controlled by a Camile data acquisition and control system along with the connected automated control valves and other devices.

1300.20 g of C16 rich 2-Alkyl Primary Alcohol composition from Example 4 is added to the reactor along with 2.984 g of 46.6% active KOH solution in water. The reactor is purged of air using vacuum and nitrogen cycles. Water is removed by sparging with nitrogen. This is done by adding a trickle of nitrogen through the drain valve located on the bottom of the reactor while using a water aspirator for a vacuum source and adjusting the reactor temperature to ~110° C. and while keeping the reactor pressure below −12 psig by adjusting the nitrogen flow rate. After 2 hours the nitrogen sparge is stopped and the reactor is filled with nitrogen from above and then vented off to ~0 psig. The reactor is closed off and then heated to between 110 and 120° C. with the agitator stir rate adjusted to ~250 rpm (used throughout). 118.65 grams of Ethylene oxide is slowly added to the reactor using automated control valves. The addition of ethylene oxide causes the reactor temperature to increase but this is managed by automated cooling water while controlling the rate at which the ethylene oxide is added. The total pressure is kept below 200 psig until all the ethylene oxide is added. The reaction is allowed to run for a total of about 1.5 hours. During this time, the pressure from the ethylene oxide slowly drops as it is consumed by the reaction and eventually the pressure levels off and is constant for ~30 minutes. Residual ethylene oxide is removed by sparging with nitrogen while using a water aspirator for a vacuum source. During this procedure, the reactor temperature is kept at ~110° C. and the reactor pressure is kept below −12 psig. After 30 minutes, the reactor is cooled to 50° C. and a 514.70 g sample of C16 rich 2-Alkyl Primary Alcohol 0.5 Mole Ethoxylate is drained from the reactor to a glass jar while keeping the sample blanketed with low pressure nitrogen. The reactor is closed off after collection of the sample. Based on mass balance calculations, 904.15 g of C16 rich 2-Alkyl Primary Alcohol 0.5 Mole Ethoxylate remains in the reactor.

The reactor heated to between 110 and 120° C. with the agitator stir rate adjusted to ~250 rpm (used throughout) and 75.61 grams of Ethylene oxide is slowly added to the reactor using automated control valves. The addition of ethylene oxide causes the reactor temperature to increase but this is managed by automated cooling water while controlling the rate at which the ethylene oxide is added. The total pressure is kept below 200 psig until all the ethylene oxide is added. The reaction is allowed to run for a total of about 1.5 hours. During this time, the pressure from the ethylene oxide slowly drops as it is consumed by the reaction and eventually the pressure levels off and is constant for ~30 minutes.

Residual ethylene oxide is removed by sparging with nitrogen while using a water aspirator for a vacuum source. During this procedure, the reactor temperature is kept at ~110° C. and the reactor pressure is kept below −12 psig. After 30 minutes, the reactor is cooled to 50° C. and based on mass balance calculation, 979.76 g of C16 rich 2-Alkyl Primary Alcohol 1 Mole Ethoxylate is contained in the reactor for drainage to a glass jar while keeping the sample blanketed with low pressure nitrogen.

81.04 grams of the above C16 rich 2-Alkyl Primary Alcohol ethoxylate (1-mole) composition and 150 milliliters of ACS Reagent Grade Diethyl Ether are added to a 1-Liter, 3-neck, round bottom flask. The flask is equipped with a magnetic stir bar for mixing, an addition funnel with a nitrogen gas feed in the center neck, a thermometer in one side neck and a tubing vent line in the other side neck leading to a gas bubbler filled with 1 Normal concentration Sodium Hydroxide to trap HCl gas evolved from reaction 34.1 grams of 98.5% Chlorosulfonic Acid is added to addition funnel. A nitrogen gas flow runs from the top of additional funnel, through the flask and out the side neck vent line to the Sodium Hydroxide bubbler. The reaction flask is cooled with an Ice/NaCl/Water bath. Begin mixing and once reaction mixture reaches 10° C., the Chlorosulfonic Acid is dripped in at a rate that maintains temperature at or below 10° C.

The Chlorosulfonic Acid addition is complete in 31 minutes. Reaction mixture is clear and nearly colorless. The Ice/NaCl/Water bath is replaced with a 20-22° C. water bath. The vent line tube attached to the Sodium Hydroxide bubbler is switched to a vacuum tube attached to a house vacuum line. A solvent trap cooled with a Dry Ice/Acetone bath is positioned along the vacuum tube between the reaction flask and the aspirator to trap volatiles pulled from the reaction mixture. A dial pressure gauge (from US Gauge reading from 0-30 inches of Hg) is positioned in the vacuum tube after the solvent trap to measure vacuum pulled on system. Reaction continues to mix for 6 minutes under nitrogen gas sweep while exchanging the water baths and setting up the vacuum system during which time the reaction mixture warms from 8° C. to 22° C.

With continued mixing, turn on vacuum to begin applying vacuum on the reaction mixture. Slowly increase the vacuum level by incrementally slowing the nitrogen gas flow from addition funnel. This is done to control foaming of the reaction mixture. Eventually the nitrogen flow is completely stopped resulting in full vacuum applied to the reaction mixture (30 inches of Hg on the vacuum gauge indicating full vacuum applied). Full vacuum is reached after 69 minutes of incrementally increasing vacuum. Broke vacuum with nitrogen gas flow, added an additional 100 ml of Diethyl Ether and began incrementally increasing vacuum as done above. Full vacuum was again reached after 1 minute and held there for 48 minutes at which point the reaction mixture was 24° C., gold in color, clear and fluid with very little bubbling observed.

With good vortex mixing using an overhead mixer with stainless steel mixing blades, slowly pour reaction mixture over approximately a 2 minute period into a mixture of 70.59 grams of 25 wt % Sodium Methoxide solution in methanol and 210 milliliters of ACS Reagent Grade Methanol contained in a stainless steel beaker cooled with an ice/water bath to convert the C16 rich 2-Alkyl Primary Alcohol Ethoxylate (1-mole) Sulfate Composition reaction product from the acid sulfate form to the sodium sulfate salt form. The resulting mixture is milky white, fluid and mixing well. Dissolve approximately 0.1 grams of the reaction product in 0.25-0.5 grams of DI water and measure pH to be 11 using a pH test strip. Let mix for an additional 15 minutes. Reaction product is poured into a flat glass dish in a fume hood. Product is allowed to dry three days yielding a white, waxy solid. Product is placed in a vacuum oven 35° C. to remove residual solvent for 48 hours. 112 grams of a white, waxy solid is recovered. Final product is determined to be 98.38% active by standard Cationic SO3 titration analysis.

Example 14

1% (wt/wt) solutions of Example 12 and Example 13 are prepared. Aliquots of the 1% solutions are mixed in the following proportions: 878 ul of Example 12 to 622 ul of Example 13.

Example 15

1% (wt/wt) solutions of Example 9, Example 12 and Example 13 are prepared. Aliquots of the 1% solutions are mixed in the following proportions: 750 ul of Example 9, 450 ul of Example 12, and 300 ul of Example 13.

Example 16

1% (wt/wt) solutions of Example 12 and Example 13 are prepared. Aliquots of the 1% solutions are mixed in the following proportions: 1200 ul of Example 12 to 300 ul of Example 13.

Additional Surfactant

In addition to the first surfactant, the detergent compositions may comprise an additional surfactant, e.g., a second surfactant, a third surfactant. The detergent composition may comprise from about 1% to about 75%, by weight of the composition, of an additional surfactant, e.g., a second surfactant, a third surfactant. The detergent composition may comprise from about 2% to about 35%, by weight of the composition, of an additional surfactant, e.g., a second surfactant, a third surfactant. The detergent composition may comprise from about 5% to about 10%, by weight of the composition, of an additional surfactant, e.g., a second surfactant, a third surfactant. The additional surfactant may be selected from the group consisting of anionic surfactants, nonionic surfactants, cationic surfactants, zwitterionic surfactants, amphoteric surfactants, ampholytic surfactants, and mixtures thereof.

Anionic Surfactants

The additional surfactant may comprise one or more anionic surfactants. Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. In one aspect a magnesium salt of LAS is used.

The detersive surfactant may be a mid-chain branched detersive surfactant, e.g., a mid-chain branched anionic detersive surfactant, such as, a mid-chain branched alkyl sulphate and/or a mid-chain branched alkyl benzene sulphonate.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants include methyl ester sulfonates and alkyl ether carboxylates.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

Nonionic Surfactants

The additional surfactant may comprise one or more nonionic surfactants. The detergent composition may comprise from about 0.1% to about 40%, by weight of the composition, of one or more nonionic surfactants. The detergent composition may comprise from about 0.1% to about 15%, by weight of the composition, of one or more nonionic surfactants. The detergent composition may comprise from about 0.3% to about 10%, by weight of the composition, of one or more nonionic surfactants.

Suitable nonionic surfactants useful herein can comprise any conventional nonionic surfactant. These can include, for e.g., alkoxylated fatty alcohols and amine oxide surfactants. In some examples, the detergent compositions may contain an ethoxylated nonionic surfactant. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfactant may be selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be f ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkyl alkoxylated alcohol. Suitable nonionic surfactants also include those sold under the tradename Lutensol® from BASF.

The nonionic surfactant may be selected from alkyl alkoxylated alcohols, such as a $C_{8-18}$ alkyl alkoxylated alcohol, for example, a $C_{8-18}$ alkyl ethoxylated alcohol. The alkyl alkoxylated alcohol may have an average degree of alkoxylation of from about 1 to about 50, or from about 1 to about 30, or from about 1 to about 20, or from about 1 to about 10, or from about 1 to about 7, or from about 1 to about 5, or from about 3 to about 7. The alkyl alkoxylated alcohol can be linear or branched, substituted or unsubstituted.

Cationic Surfactants

The detergent composition may comprise one or more cationic surfactants.

The detergent composition may comprise from about 0.1% to about 10%, or about 0.1% to about 7%, or about 0.3% to about 5% by weight of the composition, of one or more cationic surfactants. The detergent compositions of the invention may be substantially free of cationic surfactants and surfactants that become cationic below a pH of 7 or below a pH of 6.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R1)(R2)(R3)N^+X^-$$

wherein, R is a linear or branched, substituted or unsubstituted C6-18 alkyl or alkenyl moiety, R1 and R2 are independently selected from methyl or ethyl moieties, R3 is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-C6-18 alkyl mono-hydroxyethyl di-methyl quaternary ammonium chlorides. Highly suitable cationic detersive surfactants are mono-C8-10 alkyl mono-hydroxyethyl di-methyl quaternary ammonium chloride, mono-C10-12 alkyl mono-hydroxyethyl di-methyl quaternary ammonium chloride and mono-C10 alkyl mono-hydroxyethyl di-methyl quaternary ammonium chloride.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$.

Amphoteric Surfactants

Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Suitable amphoteric surfactants also include sarcosinates, glycinates, taurinates, and mixtures thereof.

Additional Branched Surfactants

The additional surfactant may comprise one or more branched surfactants, different from the 2-alkyl branched first surfactant. Suitable branched surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

The branched detersive surfactant may be a mid-chain branched detersive surfactant, e.g., a mid-chain branched anionic detersive surfactant, such as a mid-chain branched alkyl sulphate and/or a mid-chain branched alkyl benzene sulphonate.

The branched anionic surfactant may comprise a branched modified alkylbenzene sulfonate (MLAS).

The branched anionic surfactant may comprise a C12/13 alcohol-based surfactant comprising a methyl branch randomly distributed along the hydrophobe chain, e.g., Safol®, Marlipal® available from Sasol.

Additional suitable branched anionic detersive surfactants include surfactant derivatives of isoprenoid-based polybranched detergent alcohols. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference. Further suitable branched anionic detersive surfactants include those derived from anteiso and iso-alcohols.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

Combinations of Additional Surfactants

The additional surfactant may comprise an anionic surfactant and a nonionic surfactant, for example, a $C_{12}$-$C_{18}$ alkyl ethoxylate. The additional surfactant may comprise $C_{10}$-$C_{15}$ alkyl benzene sulfonates (LAS) and another anionic surfactant, e.g., $C_{10}$-$C_{18}$ alkyl alkoxy sulfates ($AE_xS$), where x is from 1-30. The additional surfactant may comprise an anionic surfactant and a cationic surfactant, for example, dimethyl hydroxyethyl lauryl ammonium chloride. The additional surfactant may comprise an anionic surfactant and a zwitterionic surfactant, for example, C12-C14 dimethyl amine oxide.

Anionic/Nonionic Combinations

The detergent compositions may comprise combinations of anionic and nonionic surfactant materials. The weight ratio of anionic surfactant to nonionic surfactant may be at least about 1.5:1 or about 2:1. The weight ratio of anionic surfactant to nonionic surfactant may be at least about 5:1. The weight ratio of anionic surfactant to nonionic surfactant may be at least about 10:1. The weight ratio of anionic surfactant to nonionic surfactant may be at least about 25:1 or at least about 100:1.

Adjunct Cleaning Additives

The detergent compositions of the invention may also contain adjunct cleaning additives. Suitable adjunct cleaning additives include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds supressors, softeners, and perfumes.

Enzymes

The cleaning compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the detergent composition.

Enzyme Stabilizing System

The detergent compositions may comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the detergent composition. In the case of aqueous detergent compositions comprising protease, a reversible protease inhibitor, such as a boron compound, including borate, 4-formyl phenylboronic acid, phenylboronic acid and derivatives thereof, or compounds such as calcium formate, sodium formate and 1,2-propane diol may be added to further improve stability.

Builders

The detergent compositions of the present invention may optionally comprise a builder. Built detergent compositions typically comprise at least about 1% builder, based on the total weight of the composition. Liquid detergent compositions may comprise up to about 10% builder, and in some examples up to about 8% builder, of the total weight of the composition. Granular detergent compositions may comprise up to about 30% builder, and in some examples up to about 5% builder, by weight of the composition.

Builders selected from aluminosilicates (e.g., zeolite builders, such as zeolite A, zeolite P, and zeolite MAP) and silicates assist in controlling mineral hardness in wash water, especially calcium and/or magnesium, or to assist in the removal of particulate soils from surfaces. Suitable builders may be selected from the group consisting of phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2.zM'O$ wherein M is Na and/or K, M' is Ca and/or Mg; y/x is 0.5 to 2.0; and z/x is 0.005 to 1.0 as taught in U.S. Pat. No. 5,427,711.

Alternatively, the composition may be substantially free of builder.

Structurant/Thickeners

Suitable structurants/thickeners include di-benzylidene polyol acetal derivative. The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. The DBPA derivative may comprise a dibenzylidene sorbitol acetal derivative (DBS).

Suitable structurants/thickeners also include bacterial cellulose. The fluid detergent composition may comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like.

Suitable structurants/thickeners also include coated bacterial cellulose. The bacterial cellulose may be at least partially coated with a polymeric thickener. The at least partially coated bacterial cellulose may comprise from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

Suitable structurants/thickeners also include cellulose fibers. The composition may comprise from about 0.01 to about 5% by weight of the composition of a cellulosic fiber. The cellulosic fiber may be extracted from vegetables, fruits or wood. Commercially available examples are Avicel® from FMC, Citri-Fi from Fiberstar or Betafib from Cosun.

Suitable structurants/thickeners also include non-polymeric crystalline hydroxyl-functional materials. The composition may comprise from about 0.01 to about 1% by weight of the composition of a non-polymeric crystalline, hydroxyl functional structurant. The non-polymeric crystalline, hydroxyl functional structurants generally may comprise a crystallizable glyceride which can be pre-emulsified to aid dispersion into the final fluid detergent composition. The crystallizable glycerides may include hydrogenated castor oil or "HCO" or derivatives thereof, provided that it is capable of crystallizing in the liquid detergent composition.

Suitable structurants/thickeners also include polymeric structuring agents. The compositions may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobic ally modified ethoxylated urethanes, hydrophobic ally modified nonionic polyols and mixtures thereof.

Suitable structurants/thickeners also include di-amido-gellants. The external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. The amido groups may be different or the same. Non-limiting examples of di-amido gellants are: N,N'-(2S,2'S)-1,1'-(dodecane-1,12-diylbis(azanediyl))bis(3-methyl-1-oxobutane-2,1-diyl)diisonicotinamide; dibenzyl(2S,2'S)-1,1'-(propane-1,3-diylbis(azanediyl))bis(3-methyl-1-oxobutane-2,1-diyl)dicarbamate; dibenzyl(2S,2'S)-1,1'-(dodecane-1,12-diylbis(azanediyl))bis(1-oxo-3-phenylpropane-2,1-diyl)dicarbamate.

Polymeric Dispersing Agents

The detergent composition may comprise one or more polymeric dispersing agents. Examples are carboxymethylcellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The detergent composition may comprise one or more amphiphilic cleaning polymers such as the compound having the following general structure: $bis((C_2H_5O)(C_2H_4O)n)$ $(CH_3)—N^+—C_xH_{2x}—N^+—(CH_3)$-bis($(C_2H_5O)(C_2H_4O)n$), wherein n=from 20 to 30, and x=from 3 to 8, or sulphated or sulphonated variants thereof.

The detergent composition may comprise amphiphilic alkoxylated grease cleaning polymers which have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Alkoxylated polycarboxylates such as those prepared from polyacrylates are useful herein to provide additional grease removal performance. Chemically, these materials comprise polyacrylates having one ethoxy side-chain per every 7-8 acrylate units. The side-chains are of the formula $—(CH_2CH_2O)_m\ (CH_2)—CH_3$ wherein m is 2-3 and n is 6-12. The side-chains are ester-linked to the polyacrylate "backbone" to provide a "comb" polymer type structure. The molecular weight can vary, but is typically in the range of about 2000 to about 50,000. The detergent compositions described herein may comprise from about 0.1% to about 10%, and in some examples, from about 0.25% to about 5%, and in other examples, from about 0.3% to about 2%, by weight of the detergent composition, of alkoxylated polycarboxylates.

Suitable amphilic graft co-polymer preferable include the amphilic graft co-polymer comprises (i) polyethyelene glycol backbone; and (ii) and at least one pendant moiety selected from polyvinyl acetate, polyvinyl alcohol and mixtures thereof. A preferred amphilic graft co-polymer is Sokalan® HP22, supplied from BASF. Suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Carboxylate polymer—The detergent compositions of the present invention may also include one or more carboxylate polymers such as a maleate/acrylate random copolymer or polyacrylate homopolymer. In one aspect, the carboxylate polymer is a polyacrylate homopolymer having a molecular weight of from 4,000 Da to 9,000 Da, or from 6,000 Da to 9,000 Da.

Soil Release Polymer

The detergent compositions of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic Polymer

The detergent compositions of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Amines

Various amines may be used in the detergent compositions described herein for added removal of grease and particulates from soiled materials. The detergent compositions described herein may comprise from about 0.1% to about 10%, in some examples, from about 0.1% to about 4%, and in other examples, from about 0.1% to about 2%, by weight of the detergent composition, of additional amines. Non-limiting examples of additional amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents—

The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition.

Bleach Catalysts—

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners

Optical brighteners or other brightening or whitening agents may be incorporated at levels of from about 0.01% to about 1.2%, by weight of the composition, into the detergent compositions described herein. Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. In some examples, the fluorescent brightener is selected from the group consisting of disodium 4,4'-bis{[4-anilino-6-morpholino-s-triazin-2-yl]-amino}-2,2'-stilbenedisulfonate (brightener 15, commercially available under the tradename Tinopal AMS-GX by Ciba Geigy Corporation), disodium4,4'-bis{[4-anilino-6-(N-2-bis-hydroxyethyl)-s-triazine-2-yl]-amino}-2,2'-stilbenedisulonate (commercially available under the tradename Tinopal UNPA-GX by Ciba-Geigy Corporation), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal 5BM-GX by Ciba-Geigy Corporation). The fluorescent brightener may be disodium 4,4'-bis {[4-anilino-6-morpholino-s-triazin-2-yl]-amino}-2,2'-stilbenedisulfonate.

The brighteners may be added in particulate form or as a premix with a suitable solvent, for example nonionic surfactant, monoethanolamine, propane diol.

The brightener may be incorporated into the detergent composition as part of a reaction mixture which is the result of the organic synthesis for the brightener molecule, with optional purification step(s). Such reaction mixtures generally comprise the brightener molecule itself and in addition may comprise un-reacted starting materials and/or by-products of the organic synthesis route.

Fabric Hueing Agents

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes, and mixtures thereof. Suitable small molecule dyes also include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Encapsulates

The compositions may comprise an encapsulate. The encapsulate may comprise a core, a shell having an inner and outer surface, where the shell encapsulates the core.

The encapsulate may comprise a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other co-monomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. When the shell comprises an aminoplast, the aminoplast may comprise polyurea, polyurethane, and/or polyureaurethane. The polyurea may comprise polyoxymethyleneurea and/or melamine formaldehyde.

The encapsulate may comprise a core, and the core may comprise a perfume. The encapsulate may comprise a shell, and the shell may comprise melamine formaldehyde and/or cross linked melamine formaldehyde. The encapsulate may comprise a core comprising a perfume and a shell comprising melamine formaldehyde and/or cross linked melamine formaldehyde Suitable encapsulates may comprise a core material and a shell, where the shell at least partially surrounds the core material. The core of the encapsulate comprises a material selected from a perfume raw material and/or optionally another material, e.g., vegetable oil, esters of vegetable oils, esters, straight or branched chain hydrocarbons, partially hydrogenated terphenyls, dialkyl phthalates, alkyl biphenyls, alkylated naphthalene, petroleum spirits, aromatic solvents, silicone oils, or mixtures thereof.

The wall of the encapsulate may comprise a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

Suitable formaldehyde scavengers may be employed with the encapsulates, for example, in a capsule slurry and/or added to a composition before, during, or after the encapsulates are added to such composition.

Suitable capsules can be purchased from Appleton Papers Inc. of Appleton, Wis. USA.

Perfumes

Perfumes and perfumery ingredients may be used in the detergent compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Dye Transfer Inhibiting Agents

Fabric detergent compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof. Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Suds Suppressors

Compounds for reducing or suppressing the formation of suds can be incorporated into the detergent compositions described herein. Suds suppression can be of particular importance in the so-called "high concentration cleaning process" and in front-loading style washing machines. The detergent compositions herein may comprise from 0.1% to about 10%, by weight of the composition, of suds suppressor.

Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons having a melting point below about 100° C., silicone suds suppressors, and secondary alcohols.

Additional suitable antifoams are those derived from phenylpropylmethyl substituted polysiloxanes.

The detergent composition may comprise a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor.

The detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

Water-Soluble Film

The compositions of the present invention may also be encapsulated within a water-soluble film. Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material.

Naturally, different film material and/or films of different thickness may be employed in making the compartments of the present invention. A benefit in selecting different films is that the resulting compartments may exhibit different solubility or release characteristics.

Suitable film materials are PVA films known under the MonoSol trade reference M8630, M8900, H8779 and PVA films of corresponding solubility and deformability characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The film is soluble or dispersible in water, and preferably has a water-solubility of at least 50%, preferably at least 75% or even at least 95%, as measured by the method set out here after using a glass-filter with a maximum pore size of 20 microns: 50 grams±0.1 gram of film material is added in a pre-weighed 400 ml beaker and 245 ml*1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The film may comprise an area of print. The area of print may cover the entire film or part thereof. The area of print may comprise a single colour or maybe comprise multiple colours, even three colours. The area of print may comprise white, black and red colours. The area of print may comprise pigments, dyes, blueing agents or mixtures thereof. The print may be present as a layer on the surface of the film or may at least partially penetrate into the film.

Suds Boosters

If high sudsing is desired, suds boosters such as the $C_{10}$-$C_{16}$ alkanolamides may be incorporated into the detergent compositions at a concentration ranging from about 1% to about 10% by weight of the detergent composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the detergent composition, to provide additional suds and to enhance grease removal performance.

Conditioning Agents

The composition of the present invention may include a high melting point fatty compound. The high melting point fatty compound useful herein has a melting point of 25° C. or higher, and is selected from the group consisting of fatty alcohols, fatty acids, fatty alcohol derivatives, fatty acid derivatives, and mixtures thereof. Such compounds of low melting point are not intended to be included in this section. The high melting point fatty compound is included in the composition at a level of from about 0.1% to about 40%, or from about 1% to about 30%, or from about 1.5% to about 16% by weight of the composition, from about 1.5% to about 8%.

The composition of the present invention may include a nonionic polymer as a conditioning agent.

The compositions of the present invention may also comprise from about 0.05% to about 3% of at least one organic conditioning oil, as the conditioning agent, either alone or in combination with other conditioning agents, such as the fabric-softening silicones (described herein). Suitable conditioning oils include hydrocarbon oils, polyolefins, and fatty esters.

Hygiene and Malodour

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Buffer System

The detergent compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Catalytic Metal Complexes

The detergent compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof.

Other Adjunct Ingredients

A wide variety of other ingredients may be used in the detergent compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The detergent compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The detergent compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The detergent compositions of the present invention may also contain antimicrobial agents.

Processes of Making Detergent Compositions

The detergent compositions of the present invention can be formulated into any suitable form and prepared by any process chosen by the formulator.

Methods of Use

The present invention includes methods for cleaning soiled material. As will be appreciated by one skilled in the art, the detergent compositions of the present invention are suited for use in laundry pretreatment applications, laundry cleaning applications, and home care applications.

Such methods include, but are not limited to, the steps of contacting detergent compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the detergent compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry detergent composition in accord with the invention. An "effective amount" of the detergent composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm in solution. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The detergent compositions herein may be used for laundering of fabrics at reduced wash temperatures. These methods of laundering fabric comprise the steps of delivering a laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry detergent composition with water.

Another method includes contacting a nonwoven substrate, which is impregnated with the detergent composition, with a soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Machine Dishwashing Methods

Methods for machine-dishwashing or hand dishwashing soiled dishes, tableware, silverware, or other kitchenware, are included. One method for machine dishwashing comprises treating soiled dishes, tableware, silverware, or other kitchenware with an aqueous liquid having dissolved or dispensed therein an effective amount of a machine dishwashing composition in accord with the invention. By an effective amount of the machine dishwashing composition it is meant from about 8 g to about 60 g of product dissolved or dispersed in a wash solution of volume from about 3 L to about 10 L.

One method for hand dishwashing comprises dissolution of the detergent composition into a receptacle containing water, followed by contacting soiled dishes, tableware, silverware, or other kitchenware with the dishwashing liquor, then hand scrubbing, wiping, or rinsing the soiled dishes, tableware, silverware, or other kitchenware. Another method for hand dishwashing comprises direct application of the detergent composition onto soiled dishes, tableware, silverware, or other kitchenware, then hand scrubbing, wiping, or rinsing the soiled dishes, tableware, silverware, or other kitchenware. In some examples, an effective amount of detergent composition for hand dishwashing is from about 0.5 ml. to about 20 ml. diluted in water.

Packaging for the Compositions

The detergent compositions described herein can be packaged in any suitable container including those constructed from paper, cardboard, plastic materials, and any suitable laminates.

Multi-Compartment Pouch Additive

The detergent compositions described herein may also be packaged as a multi-compartment detergent composition.

EXAMPLES

Experimental Methods

Dynamic Interfacial Tension Analysis

Dynamic Interfacial Tension analysis is performed on a Krüss® DVT30 Drop Volume Tensiometer (Krüss USA, Charlotte, N.C.). The instrument is configured to measure the interfacial tension of an ascending oil drop in aqueous surfactant (surfactant) phase. The oil used is canola oil (Crisco Pure Canola Oil manufactured by The J.M. Smucker Company). The aqueous surfactant and oil phases are temperature controlled at 22° C. (+/−1° C.), via a recirculating water temperature controller attached to the tensiometer. A dynamic interfacial tension curve is generated by dispensing the oil drops into the aqueous surfactant phase from an ascending capillary with an internal diameter of 0.2540 mm, over a range of flow rates and measuring the interfacial tension at each flow rate. Data is generated at oil dispensing flow rates of 500 uL/min to 1 uL/min with 2 flow rates per decade on a logarithmic scale (7 flow rates measured in this instance). Interfacial tension is measured on three oil drops per flow rate and then averaged. Interfacial tension is reported in units of mN/m. Surface age of the oil drops at each flow rate is also recorded and plots may be generated either of interfacial tension (y-axis) versus oil flow rate (x-axis) or interfacial tension (y-axis) versus oil drop surface age (x-axis). Minimum interfacial tension (mN/m) is the lowest interfacial tension at the slowest flow rate, with lower numbers indicating improved performance. Based on instrument reproducibility, differences greater than 0.1 mN/m are significant for interfacial tension values of less than 1 mM/m.

Example 17

Dynamic Oil-Water Interfacial Tension of 2-Alkyl Branched Alkyl Alkoxy Sulfates To demonstrate the benefits of the 2-alkyl branched alkyl alkoxy sulfates of the present invention, as compared to 2-alkyl branched alkyl alkoxy sulfates derived from ISALCHEM® 145, Dynamic Oil-water Interfacial Tension (DIFT) analysis is performed.

Samples containing 150 ppm of 2-alkyl branched alkyl ethoxy sulfate surfactant in water with a hardness (3:1 Ca:Mg) of 3 or 7 grains per gallon (gpg) and at pH 8.2-8.5 at 22° C. are prepared. Each sample is analyzed as described above. Density settings for 22° C. are set at 0.917 g/ml for Canola Oil and 0.998 g/ml for aqueous surfactant phase. The density of the aqueous phase is assumed to be the same as water since it is a dilute solution. 1.50 mL of 1% (wt/wt) surfactant solution in deionized water is added to a 100 ml volumetric flask to which 3.5 mL of deionized water is added and the volumetric flask is then filled to the mark with a hardness solution of 3.16 gpg or 7.37 gpg water, (3:1 CaCl2:MgCl2 solution) and mixed well. The solution is transferred to a beaker and the pH is adjusted to 8.2-8.5 by adding a few drops of 0.1N NaOH or 0.1N $H_2$504. The solution is then loaded into the tensiometer measurement cell and analyzed. The total time from mixing the surfactant solution with hardness solution to the start of analysis is five minutes.

The following 2-alkyl branched alkyl ethoxy sulfate surfactants are analyzed via DIFT measurements at 150 ppm surfactant. Analysis conditions are in water of 3 gpg or 7 gpg Calcium/Magnesium water hardness level (3:1 Calcium: Magnesium), at 22° C. and adjusted to pH 8.2-8.5. Table 6 shows the chain length distributions of the 2-alkyl branched alkyl ethoxy sulfate surfactants that are analyzed. For samples 2 through 9, these chain length distributions are calculated based on the GC MSD/FID area percentages given in Examples 2 through 6 and adjusted for the changes in the molecular weight of the sulfated surfactants.

TABLE 6

| Sample Number | 2-alkyl branched alkyl ethoxy sulfate sample Description | % C14, m + n = 10 | % C15, m + n = 11 | % C16, m + n = 12 | Hardness (gpg) | Min IFT (mN/m), 10 uL/min | Min IFT (mN/m), 1 uL/min |
|---|---|---|---|---|---|---|---|
| 1 | ISALCHEM ® 145 EO 1 Sulfate, (Reference) from Example 1 | 54 to 68 | 32 to 45 | 0 to 3** | 3 | 2.55 | 1.18 |
| 2 | C14/C15/C16 2-alkyl alkanol EO-1.0 Sulfate from Example 8 | 25.8 | 60.8 | 13.4 | 3 | 1.98 | 0.69 |
| 3 | C14/C15/C16 2-alkyl alkanol EO 1.0 sulfate from Example 9 | 26.2 | 61.9 | 11.9 | 3 | 2.10 | 0.68 |
| 4 | C14/C15/C16 2-alkyl alkanol EO-1.0 Sulfate from Example 11 | 25.8 | 60.9 | 13.3 | 3 | 2.21 | 0.83 |
| 5 | C15-rich 2-alkyl alkanol EO-1.0 Sulfate from Example 12 | 0 | 98.1 | 1.9 | 3 | 1.67 | 0.53 |
| 6 | C16-rich 2-alkyl alkanol EO-1.0 Sulfate from Example 13 | 0.7 | 5.6 | 93.7 | 3 | 2.04 | 0.60 |
| 7 | C15/C16 2-alkyl alkanol EO-1.0 Sulfate from Example 14 | 0.3 | 59.8 | 39.9 | 3 | 1.74 | 0.46 |
| 8 | C14/C15/C16 2-alkyl alkanol EO-1.0 Sulfate from Example 15 | 13.3 | 61.5 | 25.2 | 3 | 1.74 | 0.50 |
| 9 | C15/C16 2-alkyl alkanol EO-1.0 Sulfate from Example 16 | 0.2 | 79.6 | 20.2 | 3 | 1.58 | 0.47 |
| 1 | ISALCHEM ® 145 EO 1 sulfate, (Reference) from Example 1 | 54 to 68 | 32 to 45 | 0 to 3** | 7 | 1.98 | 0.65 |
| 2 | C14/C15/C16 2-alkyl alkanol EO-1.0 Sulfate from Example 8 | 25.8 | 60.8 | 13.4 | 7 | 1.64 | 0.53 |
| 3 | C14/C15/C16 2-alkyl alkanol EO 1.0 sulfate from Example 9 | 26.2 | 61.9 | 11.9 | 7 | 1.71 | 0.50 |
| 4 | C14/C15/C16 2-alkyl alkanol EO-1.0 Sulfate from Example 11 | 25.8 | 60.9 | 13.3 | 7 | 1.72 | 0.57 |
| 5 | C15-rich 2-alkyl alkanol EO-1.0 Sulfate from Example 12 | 0 | 98.1 | 1.9 | 7 | 1.49 | 0.47 |
| 6 | C16-rich 2-alkyl alkanol EO-1.0 Sulfate from Example 13 | 0.7 | 5.6 | 93.7 | 7 | 2.07 | 0.59 |
| 7 | C15/C16 2-alkyl alkanol EO-1.0 Sulfate from Example 14 | 0.3 | 59.8 | 39.9 | 7 | 1.98 | 0.52 |
| 8 | C14/C15/C16 2-alkyl alkanol EO-1.0 Sulfate from Example 15 | 13.3 | 61.5 | 25.2 | 7 | 1.88 | 0.49 |
| 9 | C15/C16 2-alkyl alkanol EO-1.0 Sulfate from Example 16 | 0.2 | 79.6 | 20.2 | 7 | 1.77 | 0.46 |

*Chainlength percentages for ISALCHEM ® 145 alkyl sulfate are based on ranges published by Sasol for ISALCHEM ® 145 alcohol.

**Value represents level for C16 and higher.

Based on instrument reproducibility, differences greater than 0.1 mN/m are significant for interfacial tension values of less than 1 mN/m.

Example 18-23

Formulation Examples

Example 18

Granular Laundry Detergent Compositions

TABLE 7

| Ingredient | A (wt %) | B (wt %) | C (wt %) | D (wt %) | E (wt %) | F (wt %) |
|---|---|---|---|---|---|---|
| 2-alkyl branched alkyl ethoxy sulfate of Invention | 1 | 2 | 0.5 | 5 | 1 | 10 |
| LAS | 20 | 8 | 20 | 15 | 19.5 | 2 |
| $C_{12-14}$ Dimethylhydroxyethyl ammonium chloride | 4 | 0.2 | 1 | 0.6 | 0.0 | 0 |
| AES | 0.9 | 1 | 0.9 | 0.0 | 4 | 0.9 |
| AE | 0.0 | 0.0 | 0.0 | 1 | 0.1 | 4 |
| Sodium tripolyphosphate | 5 | 0.0 | 4 | 9 | 2 | 0.0 |
| Zeolite A | 0.0 | 1 | 0.0 | 1 | 4 | 1 |
| 1.6 R Silicate ($SiO_2$:$Na_2O$ at ratio 1.6:1) | 10 | 5 | 2 | 3 | 3 | 5 |
| Sodium carbonate | 25 | 20 | 25 | 15 | 18 | 30 |
| TAED | 0 | 3.2 | 2 | 4 | 1 | 0 |
| NOBS | 0 | 0 | 2 | 0 | 1 | 0 |
| Percarbonate | 0 | 14.1 | 15 | 20 | 10 | 0 |
| Acrylate Polymer | 1 | 0.6 | 4 | 1 | 1.5 | 1 |
| PEG-PVAc Polymer | 0.1 | 0.2 | 0.0 | 4 | 0.05 | 0.0 |
| Carboxymethyl cellulose | 1 | 0.3 | 1 | 1 | 1 | 2 |
| Stainzyme ® (20 mg active/g) | 0.1 | 0.2 | 0.1 | 0.2 | 0.0 | 0.1 |
| Protease (Savinase ®, 32.89 mg active/g) | 0.1 | 0.1 | 0.1 | 0.1 | 0.4 | 0.1 |
| Amylase-Natalase ® (8.65 mg active/g) | 0.2 | 0.0 | 0.1 | 0.0 | 0.1 | 0.1 |
| Lipase-Lipex ® (18 mg active/g) | 0.03 | 0.07 | 0.3 | 0.1 | 0.0 | 1.0 |
| Fluorescent Brightener | 0.06 | 0.0 | 0.18 | 0.4 | 0.1 | 0.06 |
| Chelant | 0.6 | 2 | 0.6 | 0 | 0.6 | 0.6 |
| $MgSO_4$ | 0.3 | 1 | 1 | 0.5 | 1 | 1 |
| Sulphonated zinc phthalocyanine | 0.1 | 0.0 | 0.0012 | 0.01 | 0.0021 | 0.0 |
| Hueing Agent | 0.0 | 0.0 | 0.0003 | 0.001 | 0.01 | 0.1 |
| Sulfate/Water & Miscellaneous | | | Balance | | | |

All enzyme levels are expressed as % enzyme raw material.

Example 19

Granular Laundry Detergent Compositions

TABLE 8

| Ingredient | G (wt %) | H (wt %) | I (wt %) | J (wt %) | K (wt %) | L (wt %) | M (wt %) |
|---|---|---|---|---|---|---|---|
| 2-alkyl branched alkyl ethoxy sulfate of Invention | 1 | 2 | 0.5 | 10 | 1 | 2 | 5 |
| LAS | 8 | 7.1 | 5 | 1 | 7.5 | 7.5 | 2.0 |
| AES | 0 | 4.8 | 1.0 | 3 | 4 | 4 | 0 |
| AS | 1 | 0 | 1 | 0 | 0 | 0 | 0 |
| AE | 2.2 | 0 | 2.2 | 0 | 0 | 0 | 6.5 |
| $C_{10-12}$ Dimethyl hydroxyethylammonium chloride | 0.5 | 1 | 4 | 1 | 0 | 0 | 0 |
| Crystalline layered silicate (δ-$Na_2Si_2O_5$) | 4 | 0 | 5 | 0 | 10 | 0 | 0 |
| TAED | 0 | 3.2 | 2 | 1 | 1 | 0 | 0 |
| NOBS | 0 | 0 | 2 | 0 | 1 | 0 | 0 |

TABLE 8-continued

| Ingredient | G (wt %) | H (wt %) | I (wt %) | J (wt %) | K (wt %) | L (wt %) | M (wt %) |
|---|---|---|---|---|---|---|---|
| Percarbonate | 0 | 14.1 | 15 | 10 | 10 | 0 | 0 |
| Zeolite A | 5 | 0 | 5 | 0 | 2 | 2 | 0.5 |
| Citric Acid | 3 | 5 | 3 | 4 | 2.5 | 3 | 2.5 |
| Sodium Carbonate | 15 | 20 | 14 | 20 | 23 | 30 | 23 |
| Silicate 2R ($SiO_2$:$Na_2O$ at ratio 2:1) | 0.08 | 0 | 1 | 0 | 10 | 0 | 0 |
| Soil release agent | 2 | 0.72 | 0.71 | 0.72 | 0 | 0 | 0 |
| Acrylate Polymer | 1.1 | 3.7 | 1.0 | 3.7 | 2.6 | 3.8 | 4 |
| Carboxymethylcellulose | 0.15 | 1.4 | 0.2 | 2 | 1 | 0.5 | 0.5 |
| Protease-Purafect ® (84 mg active/g) | 0.2 | 0.2 | 0.4 | 0.15 | 0.08 | 0.13 | 0.13 |
| Amylase-Stainzyme Plus ® (20 mg active/g) | 0.2 | 0.15 | 0.2 | 0.3 | 0.15 | 0.15 | 0.15 |
| Lipase-Lipex ® (18.00 mg active/g) | 0.05 | 0.15 | 0.1 | 0 | 0 | 0 | 0 |
| Amylase-Natalase ® (8.65 mg active/g) | 0.1 | 0.2 | 0 | 0 | 0.15 | 0.15 | 0.15 |
| Cellulase-Celluclean ™ (15.6 mg active/g) | 0 | 0 | 0 | 0 | 0.1 | 0.1 | 0.2 |
| Chelant | 0.2 | 0.5 | 2 | 0.2 | 0.2 | 0.4 | 0.2 |
| $MgSO_4$ | 0.42 | 0.42 | 0.42 | 0.42 | 0.4 | 0.4 | 0.4 |
| Perfume | 0.1 | 0.6 | 0.5 | 0.6 | 0.6 | 0.6 | 1.0 |
| Suds suppressor agglomerate | 0.05 | 0.1 | 0 | 0.1 | 0.06 | 0.05 | 0.05 |
| Soap | 0.45 | 0.45 | 0.45 | 1 | 0 | 0 | 0 |
| Sulphonated zinc phthalocyanine | 0.0007 | 0.0012 | 0.0007 | 0.1 | 0.001 | 0 | 0 |
| Hueing Agent | 0 | 0.03 | 0.0001 | 0.0001 | 0 | 0 | 0.1 |
| Sulfate/Water & Miscellaneous | Balance | | | | | | |

All enzyme levels are expressed as % enzyme raw material.\

Example 20

Heavy Duty Liquid Laundry Detergent Compositions

TABLE 9

| | N (wt %) | O (wt %) | P (wt %) | Q (wt %) | R (wt %) | S (wt %) | T (wt %) |
|---|---|---|---|---|---|---|---|
| 2-alkyl branched alkyl ethoxy sulfate of Invention | 2 | 6 | 10 | 5 | 2 | 20 | 15 |
| AES | 15 | 10 | 4 | 5 | 1 | 4 | 15 |
| LAS | 1.4 | 4 | 2 | 1.5 | 8 | 1 | 4 |
| HSAS | 2 | 0 | 0 | 0 | 0 | 0 | 0 |
| AE | 0.4 | 0.6 | 0.3 | 1.5 | 4 | 1 | 6 |
| Lauryl Trimethyl Ammonium Chloride | 0 | 1 | 0.5 | 0 | 0.25 | 0 | 0 |
| $C_{12-14}$ dimethyl Amine Oxide | 0.3 | 2 | 0.23 | 0.37 | 0 | 0 | 0 |
| Sodium formate | 1.6 | 0.09 | 1.2 | 0 | 1.6 | 0 | 0.2 |
| Calcium formate | 0 | 0 | 0 | 0.04 | 0 | 0.13 | 0 |
| Calcium Chloride | 0.01 | 0.08 | 0 | 0 | 0 | 0 | 0 |
| Monoethanolamine | 1.4 | 1.0 | 4.0 | 0.5 | 0 | 0 | To pH 8.2 |
| Diethylene glycol | 5.5 | 0.0 | 4.1 | 0.0 | 0.7 | 0 | 0 |
| Chelant | 0.15 | 0.15 | 0.11 | 0.07 | 0.5 | 0.11 | 0.8 |
| Citric Acid | 2.5 | 3.96 | 1.88 | 1.98 | 0.9 | 2.5 | 0.6 |
| $C_{12-18}$ Fatty Acid | 0.8 | 3.5 | 0.6 | 0.99 | 1.2 | 0 | 15.0 |
| 4-formyl-phenylboronic acid | 0 | 0 | 0 | 0 | 0.1 | 0.02 | 0.01 |
| Borax | 1.43 | 2.1 | 1.1 | 0.75 | 0 | 1.07 | 0 |
| Ethanol | 1.54 | 2 | 1.15 | 0.89 | 0 | 3 | 7 |
| Ethoxylated Polyethylenimine | 0 | 1.4 | 0 | 2.5 | 0 | 0 | 0.8 |
| Zwitterionic ethoxylated quaternized sulfated hexamethylene diamine | 2.1 | 0 | 0.7 | 1.6 | 0.3 | 1.6 | 0 |
| PEG-PVAc Polymer | 0.1 | 0.2 | 0.0 | 4 | 0.05 | 0.0 | 1 |
| Grease Cleaning Alkoxylated Polyalkylenimine Polymer | 1 | 2 | 0 | 0 | 1.5 | 0 | 0 |
| 1,2-Propanediol | 0.0 | 6.6 | 0.0 | 3.3 | 0.5 | 2 | 8.0 |
| Cumene sulphonate | 0.0 | 0.0 | 0.5 | 1 | 2 | 0 | 0 |
| Fluorescent Brightener | 0.2 | 0.1 | 0.05 | 0.3 | 0.15 | 0.3 | 0.2 |

TABLE 9-continued

| | N (wt %) | O (wt %) | P (wt %) | Q (wt %) | R (wt %) | S (wt %) | T (wt %) |
|---|---|---|---|---|---|---|---|
| Hydrogenated castor oil derivative structurant | 0.1 | 0 | 0.4 | 0 | 0 | 0 | 0.1 |
| Perfume | 1.6 | 1.1 | 1.0 | 0.1 | 0.9 | 1.5 | 1.6 |
| Core Shell Melamine-formaldehyde encapsulate of perfume | 0.5 | 0.05 | 0.00 | 0.02 | 0.1 | 0.05 | 0.1 |
| Protease (40.6 mg active/g) | 0.8 | 0.6 | 0.7 | 0.9 | 0.7 | 0.2 | 1.5 |
| Mannanase: Mannaway ® (25 mg active/g) | 0.07 | 0.05 | 0 | 0.06 | 0.04 | 0.045 | 0.1 |
| Amylase: Stainzyme ® (15 mg active/g) | 0.3 | 0 | 0.3 | 0.1 | 0 | 0.6 | 0.1 |
| Amylase: Natalase ® (29 mg active/g) | 0 | 0.6 | 0.1 | 0.15 | 0.07 | 0 | 0.1 |
| Xyloglucanase (Whitezyme ®, 20 mg active/g) | 0.2 | 0.1 | 0 | 0 | 0.05 | 0.05 | 0.2 |
| Lipex ® (18 mg active/g) | 0.4 | 0.2 | 0.3 | 0.1 | 0.2 | 0 | 0 |
| *Water, dyes & minors | | | | Balance | | | |

*Based on total cleaning and/or treatment composition weight
All enzyme levels are expressed as % enzyme raw material.

Example 21

Unit Dose Compositions

Unit dose laundry detergent formulations of the present invention are provided below. Such unit dose formulations can comprise one or multiple compartments.

TABLE 10

| Ingredient | U | V | W | X | Y |
|---|---|---|---|---|---|
| 2-alkyl branched alkyl ethoxy sulfate of Invention | 15 | 2 | 5 | 5 | 10 |
| LAS | 5 | 18 | 9.5 | 14.5 | 7.5 |
| AES | 8 | 16 | 9.5 | 7.5 | 10 |
| AE | 13 | 3 | 16 | 2 | 13 |
| Citric Acid | 1 | 0.6 | 0.6 | 1.56 | 0.6 |
| $C_{12-18}$ Fatty Acid | 4.5 | 10 | 4.5 | 14.8 | 4.5 |
| Enzymes | 1.0 | 1.7 | 1.7 | 2.0 | 1.7 |
| Ethoxylated Polyethyleneimine | 1.4 | 1.4 | 4.0 | 6.0 | 4.0 |
| Chelant | 0.6 | 0.6 | 1.2 | 1.2 | 3.0 |
| PEG-PVAc Polymer | 4 | 2.5 | 4 | 2.5 | 1.5 |

TABLE 10-continued

| Ingredient | U | V | W | X | Y |
|---|---|---|---|---|---|
| Fluorescent Brightener | 0.15 | 0.4 | 0.3 | 0.3 | 0.3 |
| 1,2 propanediol | 6.3 | 13.8 | 13.8 | 13.8 | 13.8 |
| Glycerol | 12.0 | 5.0 | 6.1 | 6.1 | 6.1 |
| Monoethanolamine | 9.8 | 8.0 | 8.0 | 8.0 | 9.8 |
| TIPA | — | — | 2.0 | — | — |
| Triethanolamine | — | 2.0 | — | — | — |
| Sodium Cumene sulphonate | — | — | — | — | 2.0 |
| Cyclohexyl dimethanol | — | — | — | 2.0 | — |
| Water | 12 | 10 | 10 | 10 | 10 |
| Structurant | 0.1 | 0.14 | 0.14 | 0.1 | 0.14 |
| Perfume | 0.2 | 1.9 | 1 | 1.9 | 1.9 |
| Hueing Agent | 0 | 0.1 | 0.001 | 0.0001 | 0 |
| Buffers (monoethanolamine) | | | To pH 8.0 | | |
| Solvents (1,2 propanediol, ethanol) | | | To 100% | | |

All enzyme levels are expressed as % enzyme raw material.

Example 22

Liquid Bleach & Laundry Additive Detergent Formulations

TABLE 11

| Ingredients | AA | BB | CC | DD | EE | FF |
|---|---|---|---|---|---|---|
| 2-alkyl branched alkyl ethoxy sulfate of Invention | 15 | 5.5 | 2 | 2 | 4 | 10 |
| AES | 11.3 | 6 | 15.4 | 12 | 8 | 10 |
| LAS | 10.6 | 6 | 2.6 | — | — | 16 |
| HSAS | — | — | — | 3.5 | — | — |
| Chelant | 2.5 | — | 1.5 | — | — | 4.0 |
| 1,2-propandiol | — | 10 | — | — | — | 15 |
| Soil release agent | 2.0 | | | | | |
| Ethoxylated Polyethylenimine | | 1.8 | | | | |
| Acrylate Polymer | | | 2.9 | | | |
| Acusol 880 (Hydrophobically Modified Non-Ionic Polyol) | | | | 2.0 | 1.8 | 2.9 |
| Protease (55 mg/g active) | — | — | — | — | 0.1 | 0.1 |

TABLE 11-continued

| Ingredients | AA | BB | CC | DD | EE | FF |
|---|---|---|---|---|---|---|
| Amylase (30 mg/g active) | — | — | — | — | — | 0.02 |
| Perfume | — | 0.2 | 0.03 | 0.17 | — | 0.15 |
| Fluorescent Brightener | 0.21 | — | — | 0.15 | — | 0.18 |
| Water, other optional agents/components* | to 100% balance | to 100% balance | to 100% balance | to 100% balance | to 100% balance | to 100% balance |

*Other optional agents/components include suds suppressors, structuring agents such as those based on Hydrogenated Castor Oil (preferably Hydrogenated Castor Oil, Anionic Premix), solvents and/or Mica pearlescent aesthetic enhancer.
All enzyme levels are expressed as % enzyme raw material.

Example 23

Powder Bleach & Laundry Additive Detergent Formulations

TABLE 12

| Ingredients | GG | HH | II | JJ |
|---|---|---|---|---|
| 2-alkyl branched alkyl ethoxy sulfate of Invention | 0.5 | 2 | 5 | 10 |
| AE | 0.25 | 0.25 | 1 | 2 |
| LAS | 0.5 | — | 1 | 10 |
| Chelant | 1 | — | 0.5 | — |
| TAED | 10 | 5 | 12 | 15 |
| Sodium Percarbonate | 33 | 20 | 40 | 30 |
| NOBS | 7.5 | 5 | 10 | 0 |
| Mannanase (4 mg/g active) | 0.2 | — | — | 0.02 |
| Cellulase (15.6 mg/g active) | 0.2 | — | 0.02 | — |
| Perfume | — | 0.2 | 0.03 | 0.17 |
| Fluorescent Brightener | 0.21 | — | — | 0.1 |
| Sodium Sulfate | to 100% balance | to 100% balance | to 100% balance | to 100% balance |

Raw Materials for Examples 18-23

LAS is linear alkylbenzenesulfonate having an average aliphatic carbon chain length $C_{11}$-$C_{12}$ supplied by Stepan, Northfield, Ill., USA or Huntsman Corp. HLAS is acid form.

AES is $C_{12-14}$ alkyl ethoxy (3) sulfate or $C_{12-15}$ alkyl ethoxy (1.8) sulfate, supplied by Stepan, Northfield, Ill., USA or Shell Chemicals, Houston, Tex., USA.

AE is selected from $C_{12-13}$ with an average degree of ethoxylation of 6.5, $C_{11-16}$ with an average degree of ethoxylation of 7, $C_{12-14}$ with an average degree of ethoxylation of 7, $C_{14-15}$ with an average degree of ethoxylation of 7, or $C_{12-14}$ with an average degree of ethoxylation of 9, all supplied by Huntsman, Salt Lake City, Utah, USA.

AS is a $C_{12-14}$ sulfate, supplied by Stepan, Northfield, Ill., USA.

HSAS is mid-branched alkyl sulfate as disclosed in U.S. Pat. Nos. 6,020,303 and 6,060,443.

$C_{12-14}$ Dimethylhydroxyethyl ammonium chloride, supplied by Clariant GmbH, Germany.

$C_{12-14}$ dimethyl Amine Oxide is supplied by Procter & Gamble Chemicals, Cincinnati, USA.

Sodium tripolyphosphate is supplied by Rhodia, Paris, France.

Zeolite A is supplied by Industrial Zeolite (UK) Ltd, Grays, Essex, UK.

1.6R Silicate is supplied by Koma, Nestemica, Czech Republic.

Sodium Carbonate is supplied by Solvay, Houston, Tex., USA.

Acrylic Acid/Maleic Acid Copolymer is molecular weight 70,000 and acrylate:maleate ratio 70:30, supplied by BASF, Ludwigshafen, Germany.

PEG-PVAc polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Ethoxylated Polyethylenimine is a 600 g/mol molecular weight polyethylenimine core with 20 ethoxylate groups per —NH. Available from BASF (Ludwigshafen, Germany).

Zwitterionic ethoxylated quaternized sulfated hexamethylene diamine is described in WO 01/05874 and available from BASF (Ludwigshafen, Germany).

Grease Cleaning Alkoxylated Polyalkylenimine Polymer is a 600 g/mol molecular weight polyethylenimine core with 24 ethoxylate groups per —NH and 16 propoxylate groups per —NH. Available from BASF (Ludwigshafen, Germany).

Carboxymethyl cellulose is Finnfix® V supplied by CP Kelco, Arnhem, Netherlands.

Amylases (Natalase®, Stainzyme®, Stainzyme Plus®) may be supplied by Novozymes, Bagsvaerd, Denmark.

Savinase®, Lipex®, Celluclean™, Mannaway®, Pectawash®, and Whitezyme® are all products of Novozymes, Bagsvaerd, Denmark.

Proteases may be supplied by Genencor International, Palo Alto, Calif., USA (e.g. Purafect Prime®) or by Novozymes, Bagsvaerd, Denmark (e.g. Liquanase®, Coronase®).

Suitable Fluorescent Whitening Agents are for example, Tinopal® TAS, Tinopal® AMS, Tinopal® CBS-X, Sulphonated zinc phthalocyanine, available from BASF, Ludwigshafen, Germany.

Chelant is selected from, diethylenetetraamine pentaacetic acid (DTPA) supplied by Dow Chemical, Midland, Mich., USA, hydroxyethane di phosphonate (HEDP) supplied by Solutia, St Louis, Mo., USA; Ethylenediamine-N,N'-disuccinic acid, (S,S) isomer (EDDS) supplied by Octel, Ellesmere Port, UK, Diethylenetriamine penta methylene phosphonic acid (DTPMP) supplied by Thermphos, or1,2-dihydroxybenzene-3,5-disulfonic acid supplied by Future Fuels Batesville, Ark., USA Hueing agent is Direct Violet 9 or Direct Violet 99, supplied by BASF, Ludwigshafen, Germany. Soil release agent is Repel-o-tex® PF, supplied by Rhodia, Paris, France.

Suds suppressor agglomerate is supplied by Dow Corning, Midland, Mich., USA Acusol 880 is supplied by Dow Chemical, Midland, Mich., USA TAED is tetraacetylethylenediamine, supplied under the Peractive® brand name by Clariant GmbH, Sulzbach, Germany.

Sodium Percarbonate supplied by Solvay, Houston, Tex., USA.

NOBS is sodium nonanoyloxybenzenesulfonate, supplied by Future Fuels, Batesville, Ark., USA.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising from about 0.1% to about 99% by weight of the composition of a first surfactant, wherein said first surfactant consists essentially of a mixture of surfactant isomers of Formula I and surfactants of Formula II:

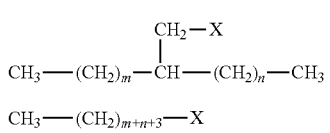

(I)

(II)

$0 \leq m, n \leq 16;$
$8 \leq m+n \leq 16$ wherein from about 50% to about 100% by weight of the first surfactant are isomers having m+n=11; wherein from about 0.001% to about 25% by weight of the first surfactant are surfactants of Formula II; and wherein X is an alkoxylated sulfate.

2. A detergent composition according to claim 1 wherein from about 0.5% to about 30% by weight of the first surfactant are isomers having m+n=10, from about 1% to about 45% by weight of the first surfactant are isomers having m+n=12, and from about 0.1% to about 20% by weight of the first surfactant are isomers having m+n=13.

3. A detergent composition according to claim 1 wherein from about 55% to about 75% by weight of the first surfactant are isomers having m+n=11, wherein from about 0.5% to about 30% by weight of the first surfactant are isomers having m+n=10; wherein from about 15% to about 45% by weight of the first surfactant are isomers having m+n=12, wherein from about 0.1% to about 20% by weight of the first surfactant are isomers having m+n=13, and wherein from about 0.001% to about 20% by weight of the first surfactant are surfactants of formula II.

4. The detergent composition according to claim 1, wherein at least about 25% by weight of the first surfactant are surfactants having m+n=10, m+n=11, m+n=12, and m+n=13, wherein n is 0, 1, or 2, or m is 0, 1, or 2.

5. The detergent composition according to claim 1, wherein X is selected from the group consisting of an ethoxylated sulfate, a propoxylated sulfate, a butoxylated sulfate, and mixtures thereof.

6. The detergent composition according to claim 1, wherein X is an ethoxylated sulfate and the average degree of ethoxylation ranges from about 0.4 to about 5, or about 0.4 to about 3.5, or about 0.4 to about 1.5, or from about 0.6 to about 1.2, or about 2.5 to about 3.5.

7. The detergent composition according to claim 1 further comprising an adjunct cleaning additive selected from the group consisting of a builder, an organic polymeric compound, an enzyme, an enzyme stabilizer, a bleach system, a brightener, a hueing agent, a chelating agent, a suds suppressor, a conditioning agent, a humectant, a perfume, a filler or carrier, an alkalinity system, a pH control system, and a buffer, and mixtures thereof.

8. The detergent composition according to claim 1, wherein said detergent composition comprises from about 0.001% to about 1% by weight of enzyme.

9. The detergent composition according to claim 1, wherein said detergent composition comprises an enzyme selected from the group consisting of lipase, amylase, protease, mannanase, cellulase, pectinase, and mixtures thereof.

10. The detergent composition according to claim 1 further comprising a second surfactant selected from the group consisting of an anionic surfactant, a cationic surfactant, a nonionic surfactant, an amphoteric surfactant, a zwitterionic surfactant, or mixtures thereof; or wherein said detergent composition comprises an anionic surfactant selected from alkyl benzene sulfonates, additional alkoxylated alkyl sulfates, alkyl sulfates, and mixtures thereof.

11. The detergent composition according to claim 1, wherein said detergent composition is a form selected from the group consisting of a granular detergent, a bar-form detergent, a liquid laundry detergent, a gel detergent, a single-phase or multi-phase unit dose detergent, a detergent contained in a single-phase or multi-phase or multi-compartment water soluble pouch, a liquid hand dishwashing composition, a laundry pretreat product, a detergent contained on or in a porous substrate or nonwoven sheet, a automatic dish-washing detergent, a hard surface cleaner, a fabric softener composition, and mixtures thereof.

12. The detergent composition according to claim 1, wherein from about 0.1% to about 100% of the carbon content of the first surfactant is derived from renewable sources.

13. A method of pretreating or treating a soiled fabric comprising contacting the soiled fabric with the detergent composition according to claim 1.

* * * * *